US011148892B2

(12) United States Patent
Egawa et al.

(10) Patent No.: US 11,148,892 B2
(45) Date of Patent: Oct. 19, 2021

(54) SHEET CONVEYING DEVICE, IMAGE FORMING APPARATUS INCORPORATING THE SHEET CONVEYING DEVICE, SHEET CONVEYING METHOD USING THE IMAGE FORMING APPARATUS INCORPORATING THE SHEET CONVEYING DEVICE, AND IMAGE FORMING METHOD USING THE IMAGE FORMING APPARATUS INCORPORATING THE SHEET CONVEYING DEVICE

(71) Applicants: Tomohiro Egawa, Kanagawa (JP); Yuichiro Maeyama, Kanagawa (JP); Motoharu Takahashi, Kanagawa (JP)

(72) Inventors: Tomohiro Egawa, Kanagawa (JP); Yuichiro Maeyama, Kanagawa (JP); Motoharu Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 105 days.

(21) Appl. No.: 16/269,915

(22) Filed: Feb. 7, 2019

(65) Prior Publication Data

US 2019/0276258 A1 Sep. 12, 2019

(30) Foreign Application Priority Data

Mar. 6, 2018 (JP) ..... JP2018-039517
Jan. 28, 2019 (JP) ..... JP2019-012248

(51) Int. Cl.
*B65H 9/00* (2006.01)
*B65H 9/20* (2006.01)
(Continued)

(52) U.S. Cl.
CPC ..... *B65H 9/002* (2013.01); *B41J 13/32* (2013.01); *B65H 7/06* (2013.01); *B65H 9/20* (2013.01);
(Continued)

(58) Field of Classification Search
CPC ..... B65H 9/002; B65H 2513/10; B41J 11/04
See application file for complete search history.

(56) References Cited

U.S. PATENT DOCUMENTS 4,733,281 A * 3/1988 Yoshinaga ..... G03G 15/5012 399/18
6,698,350 B2 * 3/2004 Iwamloto ..... B41F 7/10 101/137
(Continued)

FOREIGN PATENT DOCUMENTS

JP 6-234441 8/1994
JP 9-175694 7/1997
(Continued)

*Primary Examiner* — Patrick Cicchino
(74) *Attorney, Agent, or Firm* — Harness, Dickey & Pierce, P.L.C.

(57) ABSTRACT

A sheet conveying device includes a position detector configured to detect a position of a side end portion of a conveyance target medium, a position adjuster configured to move in at least one of a width direction of the conveyance target medium and a rotation direction of the conveyance target medium within a plane of sheet conveyance, while conveying the conveyance target medium, and adjust a position of the conveyance target medium, according to the position of the side end portion of the conveyance target medium detected by the position detector, a transfer rotary body disposed downstream from the position adjuster in a sheet conveying direction and having a receiver mounted on the rotary body to receive the conveyance target medium, and circuitry configured to change a rotation speed of the transfer rotary body according to the position of the conveyance target medium after adjusted by the position adjuster.

14 Claims, 16 Drawing Sheets

(51) Int. Cl.

| | |
|---|---|
| ***B41J 13/32*** | (2006.01) |
| ***B65H 7/06*** | (2006.01) |
| *B41J 11/00* | (2006.01) |

(52) U.S. Cl.
CPC ..... *B41J 11/0095* (2013.01); *B65H 2511/20* (2013.01); *B65H 2513/10* (2013.01)

(56) References Cited

U.S. PATENT DOCUMENTS

| | | | | |
|---|---|---|---|---|
| 7,147,222 | B2 * | 12/2006 | Christensen | B65H 7/06 271/228 |
| 10,358,309 | B2 * | 7/2019 | Yamane | B65H 9/002 |
| 2006/0288892 | A1 * | 12/2006 | Forch | B65H 5/10 101/232 |

FOREIGN PATENT DOCUMENTS

| | | |
|---|---|---|
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2008-239348 | 10/2008 |
| JP | 2008-254843 | 10/2008 |
| JP | 2011-098790 | 5/2011 |
| JP | 5959912 B2 * | 8/2016 |

* cited by examiner

SHEET CONVEYING DEVICE, IMAGE FORMING APPARATUS INCORPORATING THE SHEET CONVEYING DEVICE, SHEET CONVEYING METHOD USING THE IMAGE FORMING APPARATUS INCORPORATING THE SHEET CONVEYING DEVICE, AND IMAGE FORMING METHOD USING THE IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2018-039517, filed on Mar. 6, 2018, and 2019-012248, filed on Jan. 28, 2019, in the Japan Patent Office, the entire disclosure of each of which is hereby incorporated by reference herein.

BACKGROUND

Technical Field

This disclosure relates to a sheet conveying device that conveys a conveyance target medium, an image forming apparatus incorporating the sheet conveying device, a sheet conveying method of conveying a sheet using the image forming apparatus incorporating the sheet conveying device, and an image forming method of forming an image using the image forming apparatus incorporating the sheet conveying device.

Related Art

Various sheet conveying devices that convey a conveyance target medium are known to convey sheets such as papers and original documents in an image forming apparatus such as a copier and a printer.

In general, such sheet conveying devices are known that, when a sheet is conveyed to an image forming device or an image transfer device, the sheet that is being conveyed contacts a nip region of a pair of sheet conveying rollers that remains stopped so as to correct an angular displacement of the sheet, and then the pair of sheet conveying rollers starts rotating at a predetermined timing to convey the sheet to a target position. However, when the sheet is conveyed to contact the nip region of the pair of sheet conveying rollers, the sheet is caused to stop temporarily, and therefore the productivity in image formation degrades (in other words, the image forming speed decreases).

In order to address this inconvenience and correct positional deviations of a sheet without degrading the productivity in image formation, a known sheet conveying device has been proposed that the positional deviation of a sheet is corrected without stopping conveyance of the sheet by driving a pair of sheet conveying rollers in a direction opposite to the direction of the positional deviation of the sheet while conveying the sheet.

However, if the conveying speed of the pair of sheet conveying rollers is controlled while the pair of sheet conveying rollers is conveying the sheet in the known sheet conveying device, it is likely that slippage occurs between the pair of sheet conveying rollers and the sheet, and the timing of arrival of the sheet to the target position is changed to prevent conveyance of a sheet with high accuracy.

SUMMARY

At least one aspect of this disclosure provides a sheet conveying device including a position detector configured to detect a position of a side end portion of a conveyance target medium, a position adjuster configured to move in at least one of a width direction of the conveyance target medium and a rotation direction of the conveyance target medium within a plane of sheet conveyance, while conveying the conveyance target medium, and to adjust a position of the conveyance target medium, according to the position of the side end portion of the conveyance target medium detected by the position detector, a transfer rotary body disposed downstream from the position adjuster in a sheet conveying direction and having a receiver mounted on the rotary body to receive the conveyance target medium, and circuitry configured to change a rotation speed of the transfer rotary body according to the position of the conveyance target medium after adjusted by the position adjuster.

Further, at least one aspect of this disclosure provides an image forming apparatus including the above-described sheet conveying device.

Further, at least one aspect of this disclosure provides a sheet conveying method including detecting a position of a side end portion of a conveyance target medium, conveying the conveyance target medium according to the position of the side end portion of the conveyance target medium detected by the detecting, moving a position adjuster, during the conveying, in at least one of a width direction of the conveyance target medium and a rotation direction of the conveyance target medium within a plane of sheet conveyance, adjusting a position of the conveyance target medium, causing a transfer rotary body to receive and convey the conveyance target medium, and changing a rotation speed of the transfer rotary body according to the position of the conveyance target medium after adjusted by the adjusting.

Further, at least one aspect of this disclosure provides an image forming method including conveying a conveyance target medium using the above-described sheet conveying method, and forming an image on the conveyance target medium.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
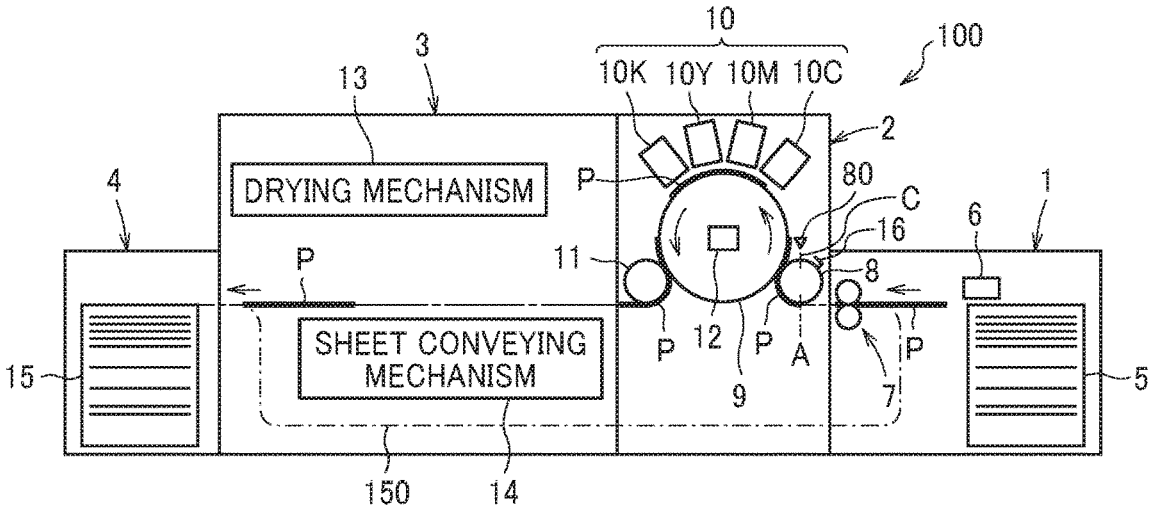
FIG. 1 is a diagram illustrating a schematic configuration of an inkjet type image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device, an image forming apparatus incorporating the sheet conveying device, a sheet conveying method of conveying a sheet using the sheet conveying device, and an image forming method of forming an image on a sheet using the sheet conveying device.

It is to be noted that elements (for example, mechanical parts and components) having the same functions and shapes are denoted by the same reference numerals throughout the specification and redundant descriptions are omitted.

FIG. 1 is a diagram illustrating a schematic configuration of an inkjet type image forming apparatus 100 according to an embodiment of this disclosure.

It is to be noted in the following examples that: the term "image forming apparatus" indicates an apparatus in which an image is formed on a recording medium such as paper, OHP (overhead projector) transparencies. OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Overall Configuration.

The inkjet type image forming apparatus 100 according to the present embodiment mainly includes a sheet feeding device 1, an image forming device 2, a drying device 3, and a sheet ejection device 4. In the inkjet type image forming apparatus 100, an image is formed by ink, which is liquid for image formation, in the image forming device 2 on a sheet P as a sheet that is supplied from the sheet feeding device 1. Then, after the ink adhered onto the sheet P is dried in the drying device 3, the sheet P is ejected from the sheet ejection device 4.

In a case in which duplex printing is performed, after an image is formed on the front face of the sheet P in the image forming device 2, the image formed on the front face of the sheet P is dried in the drying device 3. Then, the sheet P is conveyed to a sheet reverse conveyance passage 150 without ejecting the sheet P. The sheet P that has passed through the sheet reverse conveyance passage 150 is reversed and conveyed to the image forming device 2 again. In the image forming device 2, an image is formed on the back face of the sheet P. Then, the sheet P is dried in the drying device 3 and is ejected from the sheet ejection device 4.

Sheet Feeding Device.

The sheet feeding device 1 mainly includes a sheet feed tray 5, a sheet feeding unit 6, and a sheet conveying device 7. The sheet feed tray 5 is a sheet loader on which multiple sheets P are loaded. The sheet feeding unit 6 separates and feeds the multiple sheets P one by one from the sheet feed tray 5. The sheet conveying device 7 conveys the sheet P fed from the sheet feeding unit 6. The sheet feeding unit 6 may be a sheet feeding unit that includes rollers, a sheet feeding unit employing an air suction method, and any other sheet feeding units. The sheet P fed from the sheet feed tray 5 by the sheet feeding unit 6 is conveyed to the image forming device 2 by the sheet conveying device 7.

Image Forming Device.

The image forming device 2 mainly includes an upstream side transfer cylinder 8, a sheet bearing drum 9, an ink discharging device 10, and a downstream side transfer cylinder 11. The upstream side transfer cylinder 8 functions as a first transfer rotary body to receive and transfer the fed sheet P to the sheet bearing drum 9. The sheet bearing drum 9 functions as a second transfer rotary body to bear on an outer circumferential surface of the sheet bearing drum 9 and transfer the sheet P conveyed by the upstream side transfer cylinder 8. The ink discharging device 10 discharges ink toward the sheet P borne by the sheet bearing drum 9. The downstream side transfer cylinder 11 functions as a third transfer rotary body to transfer the sheet P conveyed by the sheet bearing drum 9 to the drying device 3.

It is to be noted that the upstream side transfer cylinder 8, the sheet bearing drum 9, and the downstream side transfer cylinder 11 also function as a part of the above-described sheet conveying device 7 for conveying the sheet P.

After the sheet P is conveyed from the sheet feeding device 1 to the image forming device 2, a gripper 16 that is swingable as a receiver mounted on a surface of the upstream side transfer cylinder 8 grips the leading end of the sheet P, so that the sheet P is conveyed along with the surface movement of the upstream side transfer cylinder 8. The sheet P conveyed by the upstream side transfer cylinder 8 is transferred to the sheet bearing drum 9 at an opposing position where the sheet P is brought to face the sheet bearing drum 9.

It is to be noted that a single gripper (i.e., the gripper 16) is employed in the configuration of the inkjet type image forming apparatus 100 illustrated in FIG. 1. However, the number of the gripper is not limited to one. For example, two or more grippers may be provided to the upstream side transfer cylinder 8.

A gripper, which functions as a receiver similar to the gripper 16 on the upstream side transfer cylinder 8, is provided on the surface of the sheet bearing drum 9, so that the leading end of the sheet P is gripped by the gripper mounted on the sheet bearing drum 9. Multiple air drawing openings are dispersedly formed on the surface of the sheet bearing drum 9, and a suction airflow directing toward the inside of the sheet bearing drum 9 by an air drawing device 12 is generated at each air drawing opening. The leading end of the sheet P that is transferred from the upstream side transfer cylinder 8 to the sheet bearing drum 9 is gripped by the gripper. At the same time, the sheet P is attracted to the surface of the sheet bearing drum 9 due to the suction airflow and is conveyed along with the surface movement of the sheet bearing drum 9.

The ink discharging device 10 according to the present embodiment includes liquid discharging heads 10C, 10M, 10Y and 10K having different colors of ink as C (cyan), M (magenta), Y (yellow), and K (black), respectively, to form an image. The configuration of the liquid discharging heads 10C, 10M, 10Y and 10K is not limited thereto and any other configuration may be applied as long as each liquid discharging head ejects liquid. Another liquid discharging head that ejects special ink such as white, gold and silver may be added to the ink discharging device 10 or yet another liquid discharging head that ejects a surface coating liquid that does not form an image may be provided to the ink discharging device 10.

Respective discharging operations of the liquid discharging heads 10C, 10M, 10Y and 10K of the ink discharging device 10 are individually controlled by respective drive signals according to image data. When a sheet P borne by the sheet bearing drum 9 passes by an opposing region facing the ink discharging device 10, respective color inks are discharged from the liquid discharging heads 10C, 10M, 10Y and 10K, so that an image is formed according to the image data.

It is to be noted that, in the present embodiment, the image forming device 2 is not limited to the above-described configuration and any other configuration may be applied as long as the configuration is to form an image by supplying and adhering liquid onto the sheet P.

Drying Device.

The drying device 3 mainly includes a drying mechanism 13 and a sheet conveying mechanism 14. The drying mechanism 13 dries ink that is adhered onto the sheet P in the image forming device 2. The sheet conveying mechanism 14 coveys the sheet P that is conveyed from the image forming device 2. The sheet P that is conveyed from the image forming device 2 is received by the sheet conveying mechanism 14. Then, the sheet P is conveyed to pass by the drying mechanism 13 and is transferred to the sheet ejection device 4. When passing through the drying mechanism 13, the ink on the sheet P is subjected to a drying process. By so doing, the liquid content such as moisture in the ink is evaporated, and therefore the ink is fixed onto the sheet P and curling of the sheet P is restrained.

Sheet Ejection Device.

The sheet ejection device 4 mainly includes a sheet ejection tray 15 onto which multiple sheets P are ejected and stacked. The sheets P that are sequentially conveyed from the drying device 3 are overlaid one after another and stacked on the sheet ejection tray 15.

It is to be noted that the configuration of the sheet ejection device 4 according to the present embodiment is not limited to the above-described configuration and any other configuration may be applied as long as the sheet ejection device ejects the sheet P or the multiple sheets P.

Other Additional Functional Devices.

As described above, the inkjet type image forming apparatus 100 according to the present embodiment includes the sheet feeding device 1, the image forming device 2, the drying device 3, and the sheet ejection device 4. However, other functional devices may be added appropriately. For example, the inkjet type image forming apparatus 100 may further include a pre-processing device between the sheet feeding device 1 and the image forming device 2 to perform pre-processing operations of image formation. The inkjet type image forming apparatus 100 may further include a post-processing device between the drying device 3 and the sheet ejection device 4 to perform post-processing operations of image formation.

An example of the pre-processing device performs a processing liquid applying operation to apply processing liquid onto the sheet P so as to reduce bleeding by reacting with ink. However, the content of the pre-processing operation is not limited particularly. Further, as an example of the post-processing device performs sheet reversing and conveying operations to reverse the sheet P having an image formed thereon in the image forming device 2 and convey the sheet P to the image forming device 2 again to form images on both sides of the sheet P or performs a binding operation to bind the multiple sheets P having respective images thereon. However, the content of the post-processing operation is not limited particularly.

It is to be noted that the term "image" to be formed on a sheet is not limited to visible significant images such as texts and figures but includes, for example, patterns that themselves have no meaning. In addition, the term "sheet" on which the image is formed is not limited to specific materials but may include any object to which liquid can be temporarily attached, for example, paper, thread, fiber, cloth, leather, metal, plastic, glass, wood, and ceramics, or any object to be used for film products, cloth products such as clothing, building materials such as wallpaper and flooring materials, and leather products. The term "liquid" is not particularly limited as long as the liquid has a viscosity and a surface tension that can be discharged from the liquid discharging head. However, but it is preferable that the liquid has a viscosity of 30 mPa(center dot)s or less at normal temperature and normal pressure or by heating and cooling. More specifically, the liquid includes a solvent such as water or an organic solvent, a solution including a coloring agent such as a dye or a pigment, a functionalizing material such as a polymerizable compound, a resin or a surfactant, a biocompatible material such as DNA, amino acid, protein or calcium, edible materials such as natural pigments, or suspension or emulsion. These liquids can be used for ink for inkjet printing and surface treatment liquid, for example.

In addition, the term "inkjet type image forming apparatus" indicates an apparatus in which liquid discharging head(s) and a sheet material move relatively but is not limited to this configuration. An example of the inkjet type image forming apparatus includes a serial type image forming apparatus in which the liquid discharging head moves and a line type image forming apparatus in which the liquid discharging head does not move.

Further, the term "liquid discharging head" indicates a functional component that discharges liquid from liquid discharging holes (nozzles). As an energy generation source for discharging liquid, a discharging energy generating device, e.g., a piezoelectric actuator (stacked piezoelectric element and thin film piezoelectric element), a thermal actuator using an electrothermal transducer such as a heating resistor, and an electrostatic actuator including a diaphragm and a counter electrode, can be used. However, the discharging energy generating device to be used is not limited.

Next, a description is given of the sheet conveying device 7 included in the sheet feeding device 1 of the inkjet type image forming apparatus 100 according to the present embodiment of this disclosure.

Figure 2:
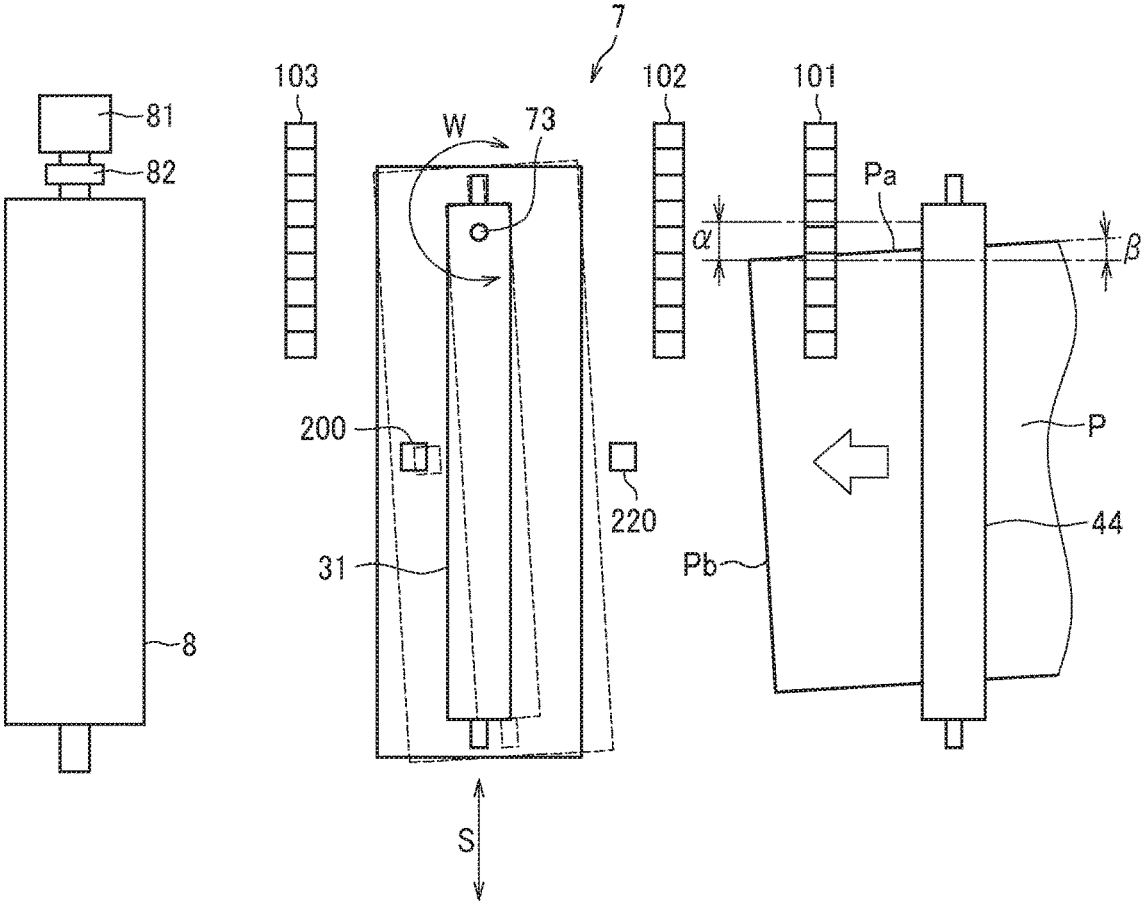
FIG. 2 is a plan view illustrating a sheet conveying device according to an embodiment of this disclosure.

FIG. 2 is a diagram illustrating the sheet conveying device 7 according to the present embodiment of this disclosure.

As illustrated in FIG. 2, the sheet conveying device 7 includes three contact image sensors (CIS), which are the first CIS 101, the second CIS 102, and the third CIS 103, two leading end detection sensors, which are a downstream side leading end detection sensor 200 and an upstream side leading end detection sensor 220, and the pair of sheet gripping rollers 31. The first CIS 101, the second CIS 102 and the third CIS 103 function as position detectors to detect the position of the sheet P. The downstream side leading end detection sensor 200 and the upstream side leading end detection sensor 220 function as sheet conveyance timing detectors to detect a sheet conveyance timing of the sheet P. The pair of sheet gripping rollers 31 functions as a position adjuster to change (adjust) the position of the sheet P while gripping the sheet P under conveyance. In the following description, the first CIS 101 that functions as a first position detector, the second CIS 102 that functions as a second position detector, and the third CIS 103 that functions as a third position detector are disposed from an upstream side to a downstream side of the sheet conveying direction of the sheet P. Further, the downstream side leading end detection sensor 200 is disposed downstream from the pair of sheet gripping rollers 31 in the sheet conveying direction and functions as a first sheet conveyance timing detector. The upstream side leading end detection sensor 220 is disposed upstream from the pair of sheet gripping rollers 31 in the sheet conveying direction functions as a second sheet conveyance timing detector.

The "CIS" stands for a contact image sensor that contributes to a reduction in size of a device in recent years. The CIS uses small-size LEDs (light emitting diodes) as light sources to directly read an image by linear sensors via lenses. Each of the first CIS 101, the second CIS 102 and the third CIS 103 includes multiple line sensors aligned in the width direction of the sheet P so as to detect a side edge Pa of one end side in the width direction of the sheet P. Specifically, the first CIS 101 and the second CIS 102 are disposed upstream from the pair of sheet gripping rollers 31 in the sheet conveying direction of the sheet P and disposed downstream from the pair of sheet conveying rollers 44 that is disposed at one upstream position from the pair of sheet gripping rollers 31 in the sheet conveying direction of the sheet P. By contrast, the third CIS 103 is disposed downstream from the pair of sheet gripping rollers 31 in the sheet conveying direction of the sheet P and disposed upstream from the upstream side transfer cylinder 8 in the sheet conveying direction of the sheet P. The first CIS 101, the second CIS 102, and the third CIS 103 are disposed parallel to each other relative to the width direction of the sheet P (i.e., a direction perpendicular to the sheet conveying direction of the sheet P).

Each of the downstream side leading end detection sensor 200 and the upstream side leading end detection sensor 220 includes a reflective optical sensor. The upstream side leading end detection sensor 220 is disposed upstream from the pair of sheet gripping rollers 31 in the sheet conveying direction of the sheet P and downstream from the second CIS 102 in the sheet conveying direction of the sheet P. The downstream side leading end detection sensor 200 is disposed downstream from the pair of sheet gripping rollers 31 in the sheet conveying direction of the sheet P and upstream from the third CIS 103 in the sheet conveying direction of the sheet P. As the sheet P is conveyed, a leading end portion Pb of the sheet P is detected by the upstream side leading end detection sensor 220. Consequently, the sheet conveyance timing at which the leading end portion Pb of the sheet P reaches the upstream side leading end detection sensor 220 is detected. Further, after the sheet P is held by the pair of sheet gripping rollers 31, as the leading end portion Pb of the sheet P reaches the position of the downstream side leading end detection sensor 200, the leading end portion Pb of the sheet P is detected by the downstream side leading end detection sensor 200. Then, the sheet conveyance timing at which the leading end portion Pb of the sheet P reaches the downstream side leading end detection sensor 200 is detected.

The pair of sheet gripping rollers 31 moves in the width direction (i.e., in a direction indicated by arrow S in FIG. 2) of the sheet P while gripping the sheet P under conveyance and rotates about a support shaft 73 within a plane of sheet conveyance (i.e., in a direction indicate by arrow W in FIG. 2). By so doing, the pair of sheet gripping rollers 31 changes (adjusts) the position of the sheet P. As a result, the lateral displacement $\alpha$ of the sheet P and the angular displacement $\beta$ of the sheet P are corrected. In other words, the pair of sheet gripping rollers 31 functions as a position adjuster that is, in this case, a positional deviation corrector to correct the angular and lateral displacements of the sheet P. In the present embodiment, the support shaft 73 is provided on the one end side in the axial direction of the pair of sheet gripping rollers 31. However, the position of the support shaft 73 is not limited to the one end side in the axial direction of the pair of sheet gripping rollers 31. For example, the support shaft 73 may be provided at the axial center of the pair of sheet gripping rollers 31.

The upstream side transfer cylinder 8, which is a component of the sheet conveying device 7, includes a transfer cylinder drive motor 81 and a rotary encoder 82. The transfer cylinder drive motor 81 functions as a transfer rotary body drive device that rotates the upstream side transfer cylinder 8. The rotary encoder 82 functions as a rotation speed detector that detects the rotation speed of the upstream side transfer cylinder 8. The rotation speed of the upstream side transfer cylinder 8 is controlled based on the detection result of the rotary encoder 82.

Figure 3:
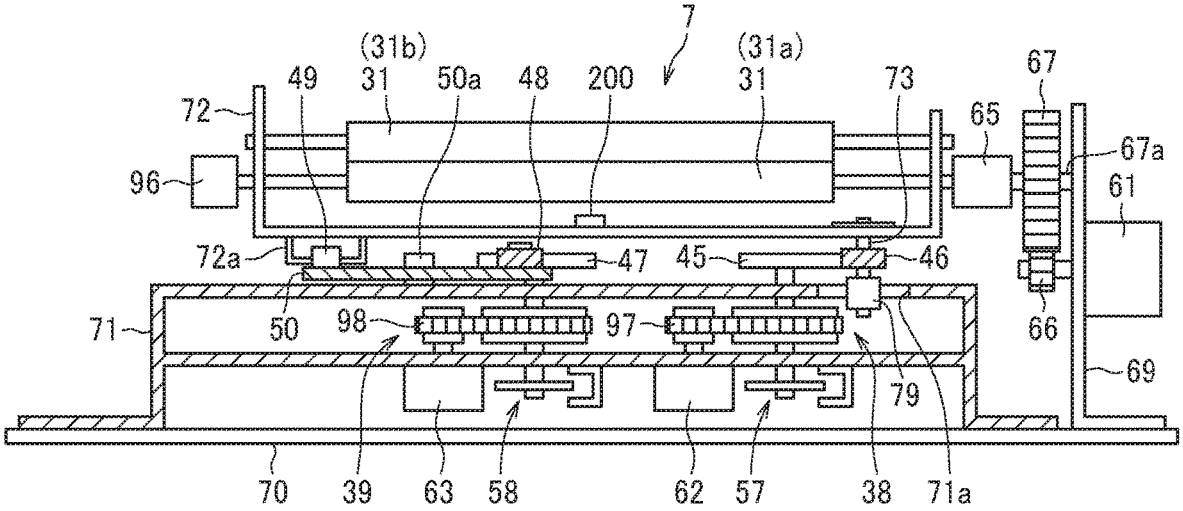
FIG. 3 is a side view illustrating a driving mechanism to drive a pair of sheet gripping rollers.
Figure 4:
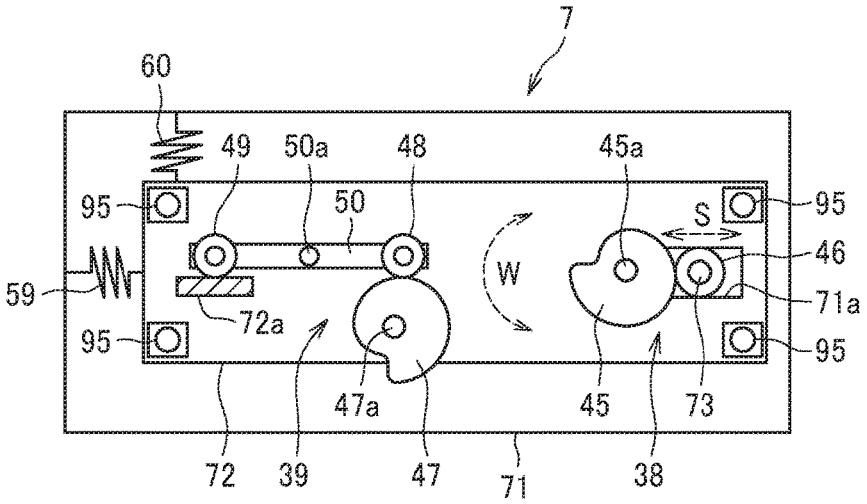
FIG. 4 is a plan view illustrating the driving mechanism to drive the pair of sheet gripping rollers.

FIGS. 3 and 4 are diagrams illustrating the pair of sheet gripping rollers 31 and a driving mechanism to drive the pair of sheet gripping rollers 31. FIG. 3 is a side view illustrating the driving mechanism and FIG. 4 is a plan view illustrating the driving mechanism.

As illustrated in FIG. 3, the pair of sheet gripping rollers 31 includes a drive roller 31*a* and a driven roller 31*b*. The drive roller 31*a* drivingly rotates about a roller shaft of the pair of sheet gripping rollers 31. The driven roller 31*b* is rotated along with rotation of the drive roller 31*a*. The pair of sheet gripping rollers 31 is rotatably held by a holder frame 72 that functions as a holding body to rotate about the roller shaft of the pair of sheet gripping rollers 31. The holder frame 72 is supported by a base frame 71 fixed to a body frame 70 of the inkjet type image forming apparatus 100.

As illustrated in FIG. 4, the holder frame 72 is mounted on the base frame 71 via free bearings (ball transfers) 95 that function as a relay support. As a result, the holder frame 72 is movable in any direction within a plane of sheet conveyance (within a plane of conveyance of a conveyance target medium) along the upper surface of the base frame 71. As described above, by supporting the holder frame 72 via the free bearings 95, the friction load generated during movement of the holder frame 72 is significantly reduced. Accordingly, correction of the angular and lateral displacements of the sheet P, which is described below, is performed at high speed and with high accuracy. In the present embodiment, the holder frame 72 is supported by the four free bearings 95. However, the number of the free bearings 95 is not limited to the above-described number. For example, the number of the free bearings 95 may be three or more.

Further, as illustrated in FIG. 3, the holder frame 72 includes the support shaft 73 that is provided to extend downwardly. The support shaft functions as a rotation center of the pair of sheet gripping rollers 31 within a plane of sheet conveyance. The lower end portion of the support shaft 73 is inserted into a lateral guide portion 71*a* formed in the base frame 71. The lateral guide portion 71*a* is an opening or a hole portion formed so as to extend substantially linearly in the width direction of the base frame 71 (i.e., the direction indicated by arrow S in FIG. 4). Further, a guide roller 79 is rotatably provided at the lower end portion of the support shaft 73. The support shaft 73 is inserted so as to contact the lateral guide portion 71*a* via the guide roller 79. As the support shaft 73 moves in the width direction of the base frame 71 along the lateral guide portion 71*a* of the base frame 71, the holder frame 72 and the pair of sheet gripping rollers 31 that is held by the holder frame 72 also move in the width direction of the base frame 71. The holder frame 72 also rotates around the support shaft 73 within a plane of sheet conveyance (in the direction indicated by arrow W in FIG. 4). As the holder frame 72 rotates around the support shaft 73, the pair of sheet gripping rollers 31 rotates within a plane of sheet conveyance.

As illustrated in FIG. 3, a bracket 69 is provided to the body frame 70 on the right end side of FIG. 3. A conveyance drive motor (conveyance drive device) 61 is provided on the bracket 69 to apply a driving force to the pair of sheet gripping rollers 31 to convey a sheet. The conveyance drive motor 61 and the drive roller 31*a* of the pair of sheet gripping rollers 31 are coupled via a gear train including multiple gears 66 and 67 and a coupling mechanism 65. The coupling mechanism 65 is a two-step spline coupling. Even if the rotary shaft of the drive roller 31*a* and a rotary shaft 67*a* of the gear 67 are separated from each other in the axial direction, come close to each other in the axial direction, or driven in a direction in which these rotary shafts are inclined with respect to each other, the coupling mechanism 65 maintains the connection so that the driving force can be transmitted. Since the drive roller 31*a* and the gear 67 are coupled via the coupling mechanism 65 as described above, even though the pair of sheet gripping rollers 31 moves in the width direction or rotates within a plane of sheet conveyance and results in a change of a relative position of the drive roller 31*a* and the conveyance drive motor 61, the conveyance drive motor 61 preferably transmits the driving force to the drive roller 31*a* of the pair of sheet gripping rollers 31.

Further, as illustrated in FIG. 3, a rotary encoder 96 is mounted at the end portion of the drive roller 31*a* (i.e., at an end portion on the opposite side from the conveyance drive motor 61). The rotary encoder 96 functions as a rotation speed detector to detect the conveyance rotation speed of the drive roller 31*a* (or the conveyance drive motor 61). The conveyance rotation speed of the pair of sheet gripping rollers 31 is controlled based on the detection result of the rotary encoder 96.

Further, the sheet conveying device 7 according to the present embodiment includes a lateral driving mechanism 38 and an angular driving mechanism 39. The lateral driving mechanism 38 causes the holder frame 72 and the pair of sheet gripping rollers 31 to move in the width direction of the sheet P. The angular driving mechanism 39 causes the holder frame 72 and the pair of sheet gripping rollers 31 to rotate in the rotation direction within a plane of sheet conveyance.

As illustrated in FIGS. 3 and 4, the lateral driving mechanism 38 includes a lateral drive motor (a lateral drive device) 62, a timing belt 97, a cam 45, and a tension spring 59. The tension spring 59 is connected to the holder frame 72 and the base frame 71 so as to bias the holder frame 72 in one direction (i.e., the left direction in FIG. 4) in the width direction of the base frame 71. The cam 45 is provided to the base frame 71 to be rotatable about a rotary shaft 45*a*. Further, the cam 45 is held in contact with a cam follower 46 provided to the support shaft 73 due to the biasing force of the tension spring 59. As the cam 45 rotates, the cam follower 46 is pushed against the biasing force applied by the tension spring 59. Accordingly, the holder frame 72 moves in the width direction (i.e., the right direction in FIG. 4).

Further, as illustrated in FIG. 3, the timing belt 97 is wound around the rotary shaft 45*a* of the cam 45 and the motor shaft of the lateral drive motor 62. As a result, the driving force is transmitted from the lateral drive motor 62 to the cam 45 via the timing belt 97. Further, a rotary encoder 57 is mounted on the rotary shaft 45*a* of the cam 45. The rotary encoder 57 functions as a rotation angle detector to detect the rotation angle (the rotation amount) of the cam 45. By controlling the driving of the lateral drive motor 62 based on the detection result of the rotary encoder 57, the rotation angle of the cam 45 is controlled, so that the amount of movement of the holder frame 72 in the width direction is adjusted. That is, the rotary encoder 57 functions as a drive position detector that detects a drive position when the holder frame 72 and the pair of sheet gripping rollers 31 move in the width direction.

As illustrated in FIGS. 3 and 4, the angular driving mechanism 39 includes an angular drive motor (angular drive device) 63, a timing belt 98, a cam 47, a tension spring 60, and a lever 50. The tension spring 60 is connected to the holder frame 72 and the base frame 71 so as to bias the holder frame 72 in one direction of the rotation (angular) direction (i.e., a clockwise direction around the support shaft 73 in FIG. 4). The cam 47 is mounted on the base frame 71 so as to be rotatable around a rotary shaft 47*a*. In addition, the cam 47 is held in contact with a cam follower 48 provided to one end of the lever 50 due to the biasing force of the tension spring 60. An action roller 49 is rotatably provided to an end portion on the opposite side of the lever 50. The action roller 49 is held in contact with a projection 72*a* provided to the holder frame 72 due to the biasing force of the tension spring 60. With the above-described configuration, when the cam 47 rotates and the cam follower 48 is pushed by the cam 47, the lever 50 rotates about a rotary shaft 50*a*. Along with this operation, the action roller 49 that is provided to the lever 50 pushes the projection 72*a* of the holder frame 72 against the biasing force of the tension spring 60, so that the holder frame 72 rotates in the rotation direction within a plane of sheet conveyance (in a counter-clockwise direction in FIG. 4).

Further, as illustrated in FIG. 3, a timing belt 98 is wound around the rotary shaft 47*a* of the cam 47 and the motor shaft of the angular drive motor 63. According to this configuration, the driving force is transmitted from the angular drive motor 63 to the cam 47 via the timing belt 98. Further, a rotary encoder 58 is mounted on the rotary shaft 47*a* of the cam 47. The rotary encoder 58 functions as a rotation angle detector to detect the rotation angle (rotation amount) of the cam 47. By controlling the driving of the angular drive motor 63 based on the detection result of the rotary encoder 58, the rotation angle of the cam 47 is controlled, and therefore the number of rotations of the holder frame 72 in the rotation direction within a plane of sheet conveyance is adjusted. That is, the rotary encoder 58 functions as a drive position detector that detects a drive position when the holder frame 72 and the pair of sheet gripping rollers 31 rotate within a plane of sheet conveyance.

Figure 5A:
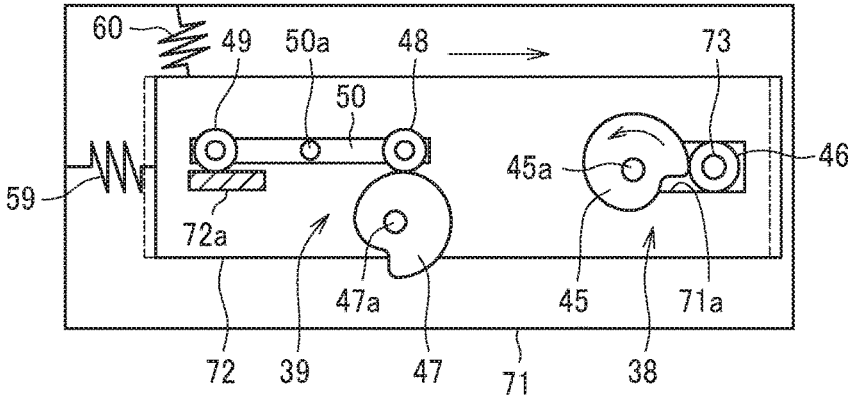
FIG. 5A is a diagram illustrating a state in which a support frame has moved in the width direction.
Figure 5B:
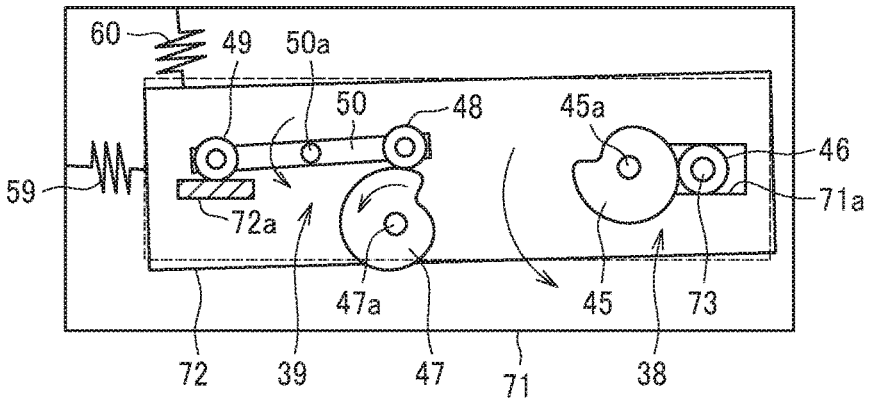
FIG. 5B is a diagram illustrating a state in which the support frame has moved in the rotational direction within a plane of sheet conveyance.
Figure 5C:
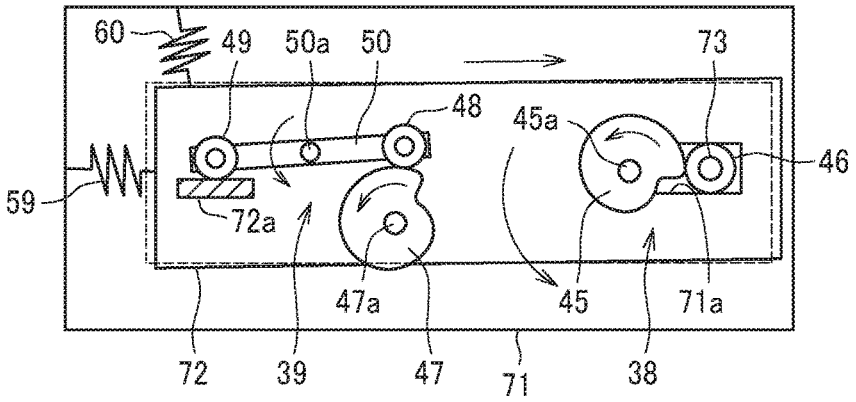
FIG. 5C is a diagram illustrating a state in which the support frame has moved in both the width direction and the rotational direction within a plane of sheet conveyance.

FIG. 5A is a diagram illustrating a state in which the cam 45 of the lateral driving mechanism 38 has rotated and the holder frame 72 has moved in the width direction. FIG. 5B is a diagram illustrating a state in which the cam 47 of the angular driving mechanism 39 has rotated and the holder frame 72 has rotated in the rotation direction within a plane of sheet conveyance. FIG. 5C is a diagram illustrating a state in which both the cam 45 and the cam 47 have rotated and the holder frame 72 has moved in the width direction and rotated in the rotation direction within a plane of sheet conveyance.

Further, as illustrated in FIG. 3, the downstream side leading end detection sensor 200 is provided to the holder frame 72. Accordingly, when the holder frame 72 moves in the width direction or rotates in the rotation direction within a plane of sheet conveyance as described above, the downstream side leading end detection sensor 200 moves together with (integrally) the holder frame 72 in the width direction or in the rotation direction within a plane of sheet conveyance. By contrast, the upstream side leading end detection sensor 220 is fixed so as not to move in the sheet conveyance passage.

Figure 6:
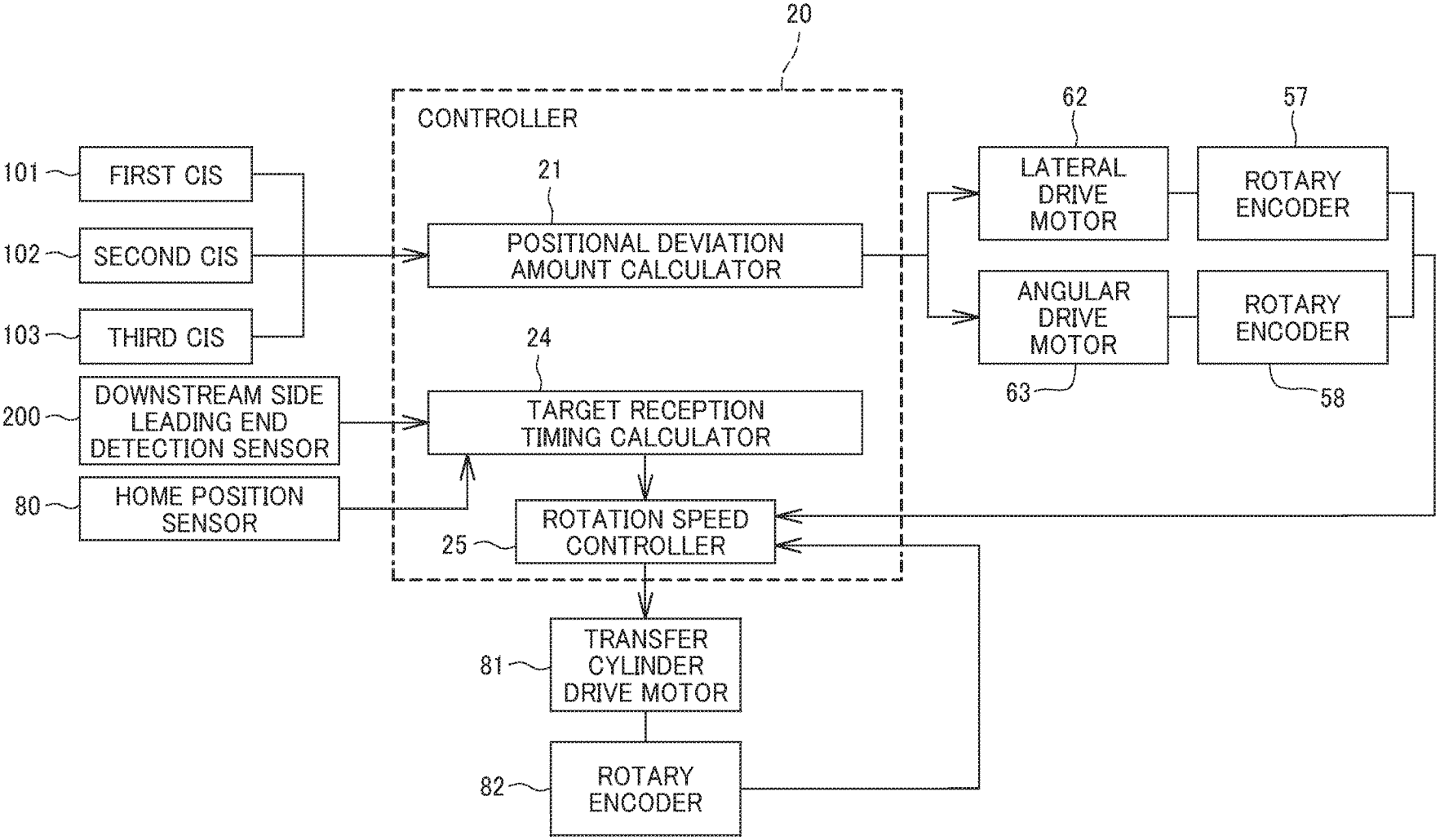
FIG. 6 is a block diagram illustrating a control system of the sheet conveying device according to an embodiment of this disclosure.

FIG. 6 is a block diagram illustrating a control system of the sheet conveying device 7 according to the present embodiment of this disclosure.

The conveyance device according to the present embodiment includes a controller 20 that controls the operation of the pair of sheet gripping rollers 31 and the operation of the upstream side transfer cylinder 8 that is disposed on the downstream side of the conveying direction of the pair of sheet gripping rollers 31. The controller 20 controls the correcting operation of the positional deviation of the sheet performed by the pair of sheet gripping rollers 31. To be more specific, the controller 20 controls the amount of movement of the pair of sheet gripping rollers 31 in the width direction, the amount of rotation of the pair of sheet gripping rollers 31 in the rotation direction within a plane of sheet conveyance, and the rotation speed of the upstream side transfer cylinder 8.

As illustrated in FIG. 6, the controller 20 includes a positional deviation amount calculator 21, a target reception timing calculator 24, and a rotation speed controller 25. The positional deviation amount calculator 21 calculates an amount of positional deviation of the sheet. The target reception timing calculator 24 calculates the target reception timing at which the upstream side transfer cylinder 8 receives the sheet P. The rotation speed controller 25 controls the conveyance rotation speed of the upstream side transfer cylinder 8.

For example, the controller 20 may be implemented using hardware, a combination of hardware and software, or a non-transitory storage medium storing software that is executable to perform the functions of the same. For example, in some example embodiments, the controller 20 may include a memory and a processing circuitry. The memory may include a nonvolatile memory device, a volatile memory device, a non-transitory storage medium, or a combination of two or more of the above-mentioned devices. The processing circuitry may be, but not limited to, a processor, Central Processing Unit (CPU), a controller, an arithmetic logic unit (ALU), a digital signal processor, a microcomputer, a field programmable gate array (FPGA), an Application Specific Integrated Circuit (ASIC), a System-on-Chip (SoC), a programmable logic unit, a microprocessor, or any other device capable of performing operations in a defined manner. The processing circuitry may be configured, through a layout design and/or execution of computer readable instructions stored in a memory, as a special purpose computer to perform the functions of the positional deviation amount calculator 21, the target reception timing calculator 24, and/or the rotation speed controller 25.

In other example embodiments, the controller 20 may include integrated circuit (IC) specially customized into special purpose processing circuitry (e.g., an ASIC) to perform the functions of the positional deviation amount calculator 21, the target reception timing calculator 24, and/or the rotation speed controller 25.

The positional deviation amount calculator 21 is configured to calculate the amount of positional deviation of the sheet based on the detection results of the first CIS 101, the second CIS 102 and the third CIS 103. Based on the calculated amount of positional deviation of the sheet, the controller 20 controls the pair of sheet gripping rollers 31. Specifically, in order to correct the positional deviation of the sheet, the controller 20 controls the lateral drive motor 62 that drives the pair of sheet gripping rollers 31 to move in the width direction of the sheet and the angular drive motor 63 that drives the pair of sheet gripping rollers 31 to rotate in the rotation direction of the sheet within a plane of sheet conveyance.

The target reception timing calculator 24 calculates the target reception timing at which the upstream side transfer cylinder 8 receives the sheet based on the conveyance position information of the sheet detected by the downstream side leading end detection sensor 200 and the rotation position information of the upstream side transfer cylinder 8 detected by the home position sensor 80 (see FIG. 1) that is mounted on the upstream side transfer cylinder 8. As described above, in the present embodiment, as the gripper 16 that is mounted on the upstream side transfer cylinder 8 grips the sheet P, the sheet P is conveyed to the upstream side transfer cylinder 8. At this time, in order to convey the sheet P to the gripper 16 reliably, the gripper 16 reaches the sheet receiving position A of the gripper 16 (see FIG. 1) in synchronization with arrival of the sheet P to the sheet receiving position A on the gripper 16. Therefore, in the present embodiment, the timing at which the sheet P reaches the sheet receiving position A is set as the above-described target reception timing.

It is to be noted that the timing at which the gripper 16 reaches the sheet gripping position A is specified by detecting a rotation reference position C of the upstream side transfer cylinder 8 by the home position sensor 80.

Further, the rotation speed controller 25 controls the rotation speed of the upstream side transfer cylinder 8 based on the detection information of the rotary encoder 82 (see FIG. 2) that detects the rotation speed of the upstream side transfer cylinder 8 and the amount of positional change of the sheet P that has changed due to the correction of positional deviation of the sheet P. Here, the amount of correction of the positional deviation of the sheet P (i.e., the amount of the angular and lateral displacements of the sheet P) corresponds to an amount of movement of the pair of sheet gripping rollers 31 that has moved in the width direction of the sheet and an amount of rotation of the pair of sheet gripping rollers 31 that has rotated in the rotation direction within a plane of sheet conveyance when the pair of sheet gripping rollers 31 performs correction of positional deviation of the sheet P. Accordingly, in the above-described embodiments, the rotation speed controller 25 receives a detection signal of the rotary encoder 57 that detects the amount of movement of the pair of sheet gripping rollers 31 in the width direction and a detection signal of the rotary encoder 58 that detects the amount of rotation of the pair of sheet gripping rollers 31 in the rotation direction within a plane of sheet conveyance, the amount of positional change of the sheet P is obtained indirectly.

The rotation speed controller 25 controls the rotation speed of the upstream side transfer cylinder 8 based on the target reception timing that has been calculated by the target reception timing calculator 24 or the corrected target reception timing that is corrected after the target reception timing calculator 24 has calculated the target reception timing.

Figure 7:
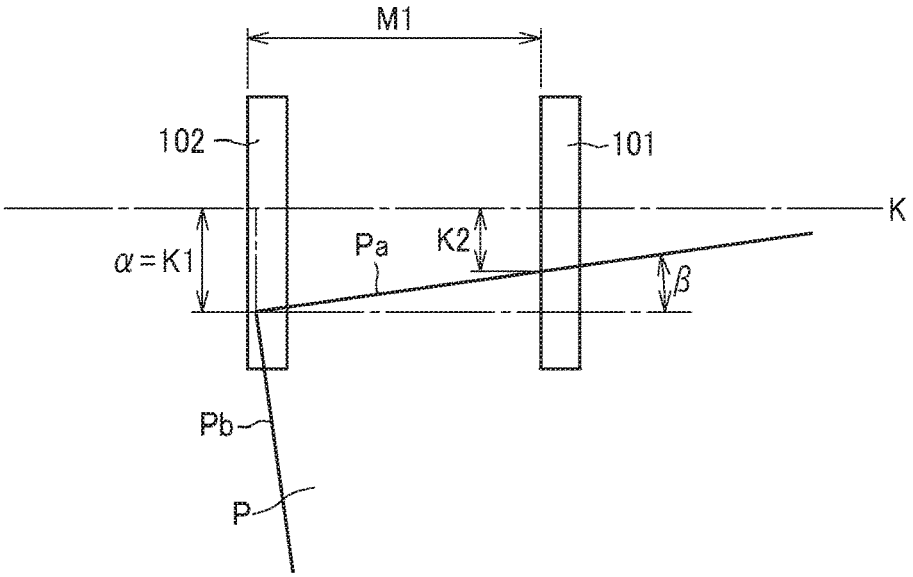
FIG. 7 is a diagram illustrating how to calculate an amount of positional deviation of the sheet based on position information of the sheet obtained by using two contact image sensors.
Figure 8:
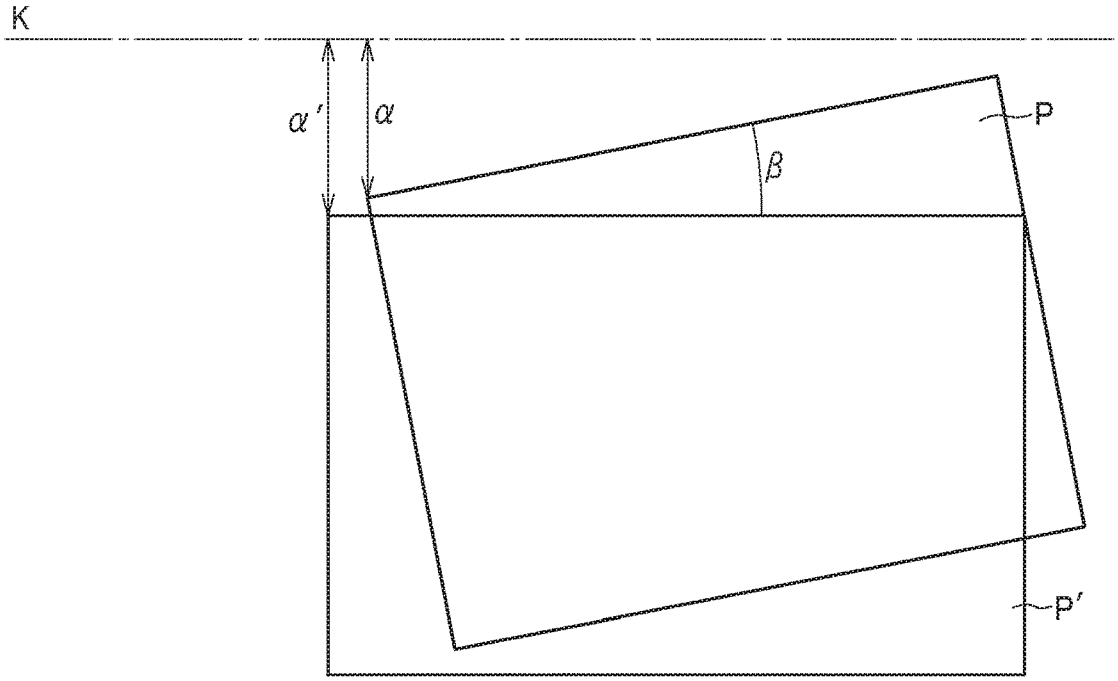
FIG. 8 is a diagram for explaining a lateral displacement amount of a sheet.

Next, a description is given of a method of calculating angular and lateral displacement amounts of a sheet, with reference to FIGS. 7 and 8.

It is to be noted that FIG. 7 illustrates a method of calculating a positional deviation amount of a sheet, that is, angular and lateral displacement amounts of a sheet using the first CIS 101 and the second CIS 102. However, the method of calculating the positional deviation amount of a sheet is not limited to this method. For example, a method of calculating angular and lateral displacement amounts of a sheet using the second CIS 102 and the third CIS 103 may also be applied to this disclosure.

As illustrated in FIG. 7, when the leading end Pb of the sheet P passes the first CIS 101 and reaches the second CIS 102, the lateral displacement amount $\alpha$ of the sheet P and the angular displacement amount $\beta$ of the sheet P are detected.

Specifically, the lateral displacement amount $\alpha$ of the sheet P is calculated based on a position of the sheet P in the width direction of the sheet P detected by the second CIS 102 (i.e., a position of the side edge Pa of the sheet P). That is, the position of the sheet P in the width direction detected by the second CIS 102 is compared with a conveyance reference position K. Consequently, a distance K1 extending between the position of the sheet P and the reference conveyance position K is calculated and obtained as a lateral displacement amount $\alpha$ of the sheet P.

Further, the angular displacement amount $\beta$ of the sheet P is calculated based on a difference of end positions in the width direction of the sheet P detected by the first CIS 101 and the second CIS 102. That is, as illustrated in FIG. 7, at a moment when the leading end Pb of the sheet P reaches the second CIS 102, the distance K1 and a distance K2 in the width direction of the sheet P from the reference conveyance position K are detected by the first CIS 101 and the second CIS 102, respectively. Consequently, since a distance M1 in the sheet conveying direction of the sheet P between the first CIS 101 and the second CIS 102 is previously determined, the angular displacement amount $\beta$ with respect to the sheet conveying direction of the sheet P is obtained based on an equation of tan $\beta$ (equal) (K1−K2)/M1.

As described above, the lateral displacement amount $\alpha$ of the sheet P and the angular displacement amount $\beta$ of the sheet P are calculated. It is to be noted that, as illustrated in FIG. 8, after the angular displacement $\beta$ has been corrected, as the position of the sheet P changes to a sheet P', the lateral displacement amount $\alpha$ of the sheet P changes to a lateral displacement amount $\alpha'$ of the sheet P'. Therefore, by previously calculating the lateral displacement amount $\alpha'$ of the sheet P', the lateral displacement $\alpha$ of the sheet P is corrected with higher accuracy. However, the lateral displacement amount $\alpha'$ of the sheet P' varies depending on a reference position of correction of the angular displacement $\beta$.

Figure 13A:
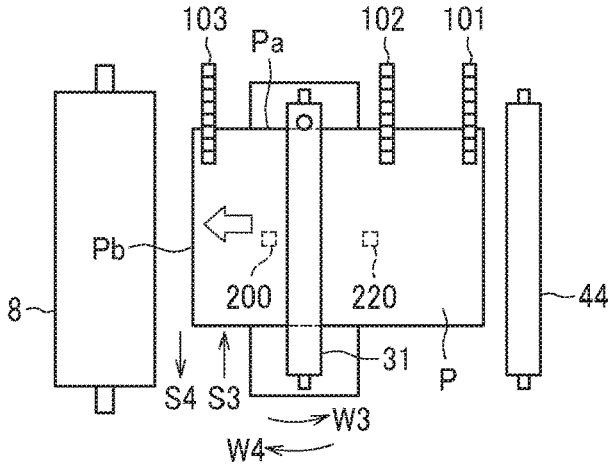
FIG. 13A is a plan view illustrating movement of the sheet conveying device according to an embodiment of this disclosure.
Figure 13B:
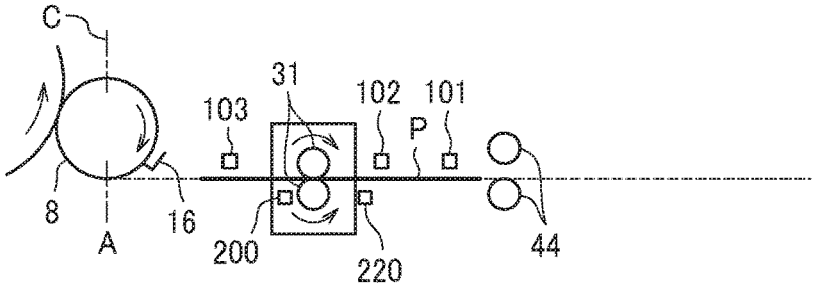
FIG. 13B is a side view illustrating the movement of the sheet conveying device of FIG. 13A.
Figure 14A:
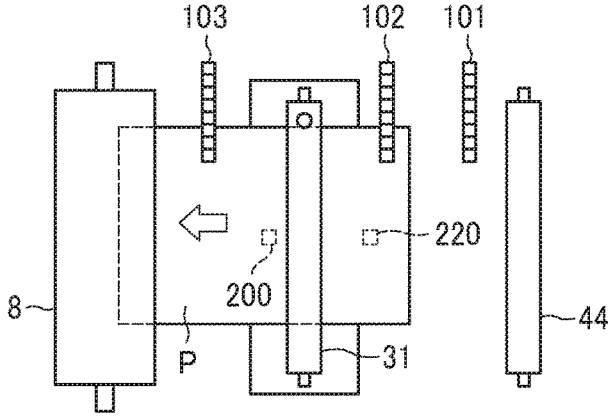
FIG. 14A is a plan view illustrating movement of the sheet conveying device according to an embodiment of this disclosure.
Figure 14B:
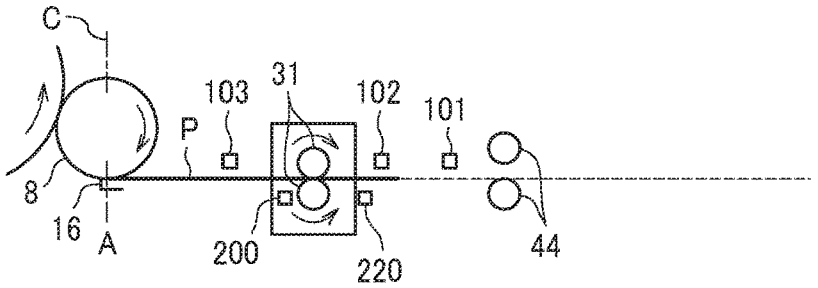
FIG. 14B is a side view illustrating the movement of the sheet conveying device of FIG. 14A.
Figure 15:
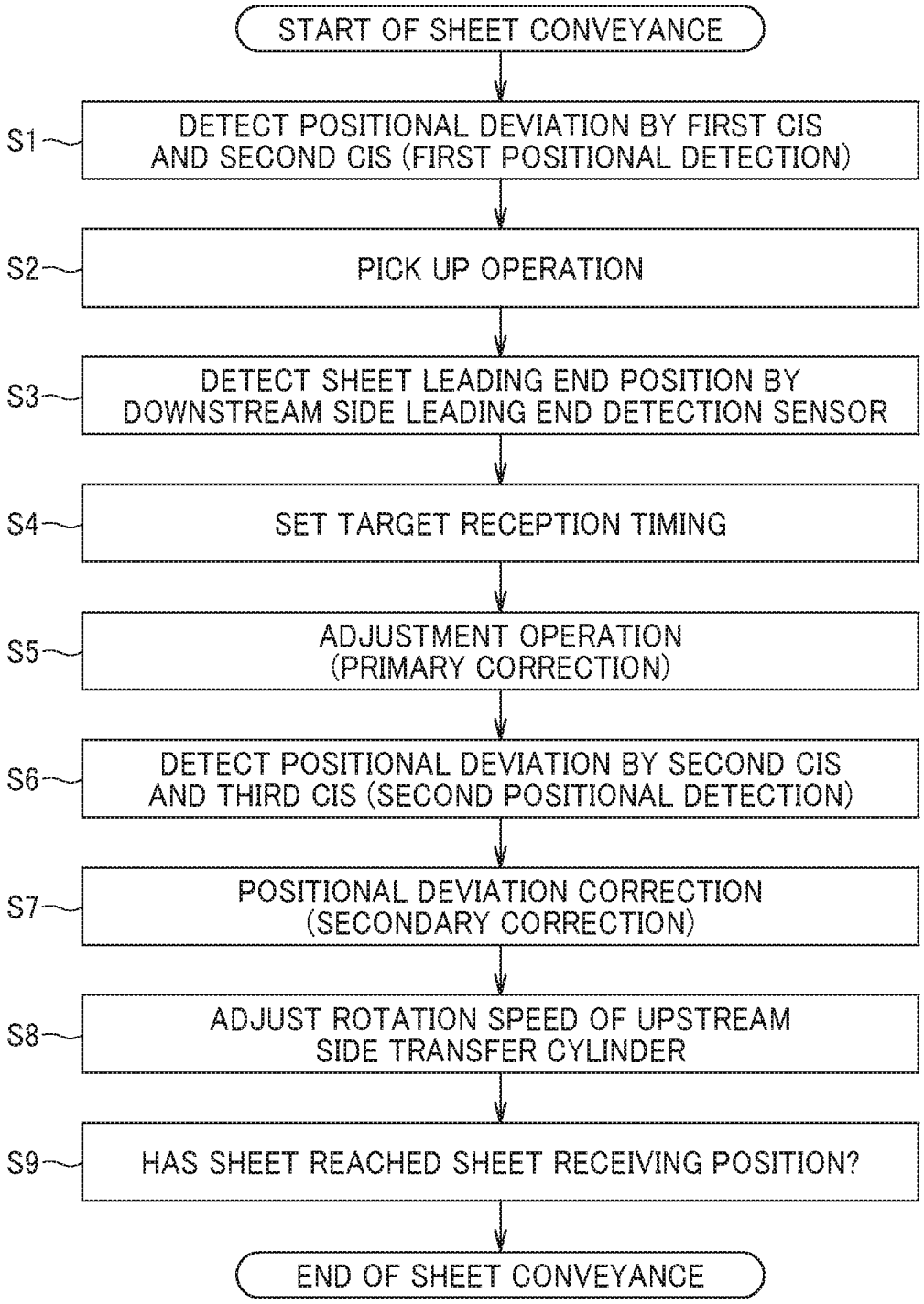
FIG. 15 is a flowchart of a sheet conveying operation performed by the sheet conveying device according to an embodiment of this disclosure.

Next, a description is given of the operations of the sheet conveying device 7 according to the present embodiment, with reference to the plan views and side views of FIGS. 9A through 14B and the flowchart of FIG. 15.

Figure 9A:
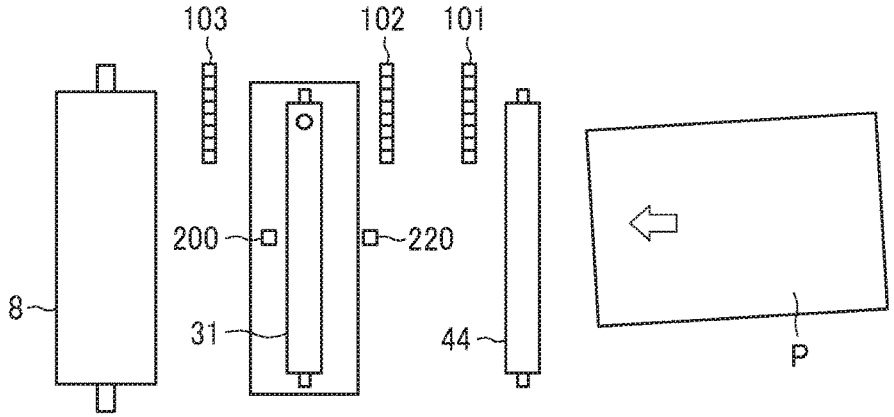
FIG. 9A is a plan view illustrating movement of the sheet conveying device according to an embodiment of this disclosure.
Figure 9B:
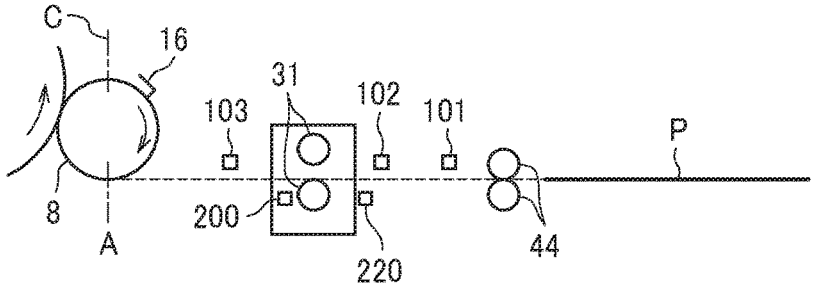
FIG. 9B is a side view illustrating the movement of the sheet conveying device of FIG. 9A.

As illustrated in FIGS. 9A and 9B, when the sheet P is approaching the pair of sheet gripping rollers 31, the pair of sheet gripping rollers 31 is located at a home position at which the roller shaft of the pair of sheet gripping rollers 31 extends in a direction perpendicular to the sheet conveying direction (i.e., in the left and right directions in FIGS. 9A and 9B). Further, in this state, the two rollers of the pair of sheet gripping rollers 31 (i.e., the drive roller 31*a* and the driven roller 31*b*) are separated from each other and remains in a stationary state.

Figure 10A:
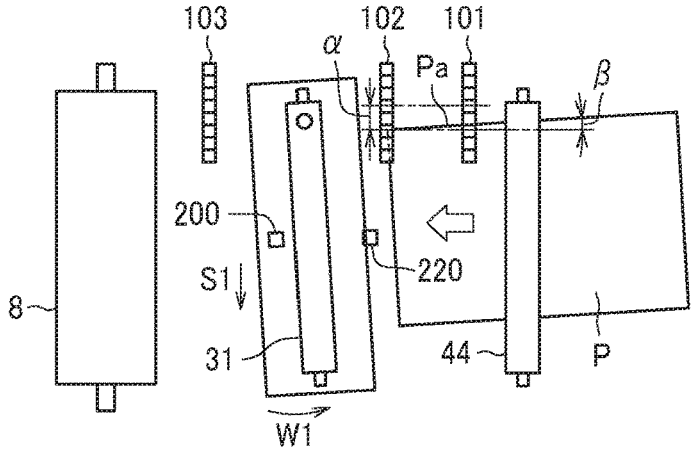
FIG. 10A is a plan view illustrating movement of the sheet conveying device according to an embodiment of this disclosure.
Figure 10B:
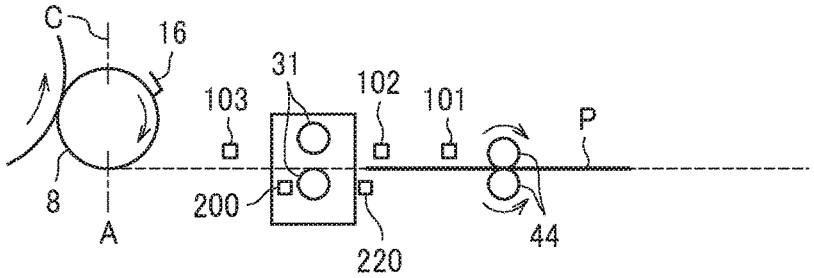
FIG. 10B is a side view illustrating the movement of the sheet conveying device of FIG. 10A.

Thereafter, as illustrated in FIGS. 10A and 10B, when the leading end portion Pb of the sheet P passes by the first CIS 101 and reaches the second CIS 102, the first CIS 101 and the second CIS 102 perform a "first position detection" to detect the position of the side end portion Pa of the sheet P (step S1 in the flowchart of FIG. 15). Then, the positional deviation amount calculator 21 (see FIG. 6) calculates the lateral displacement amount $\alpha$ (or the lateral displacement amount $\alpha'$ together with the angular displacement amount 13) based on the position information detected by the first CIS 101 and the second CIS 102. Then, based on the calculated positional deviation amount, the lateral drive motor 62 and the angular drive motor 63 are controlled to move the pair of sheet gripping rollers 31 in the width direction (i.e., in the direction indicated by arrow S1 in FIG. 10A) and rotate in the rotation direction within a plane of sheet conveyance (i.e., in the direction indicated by arrow W in FIG. 10A. As a result, the pair of sheet gripping rollers 31 performs the pick up and hold operation in which the pair of sheet gripping rollers 31 moves to face leading end Pb of the sheet P (step S2 in the flowchart of FIG. 15).

Figure 11A:
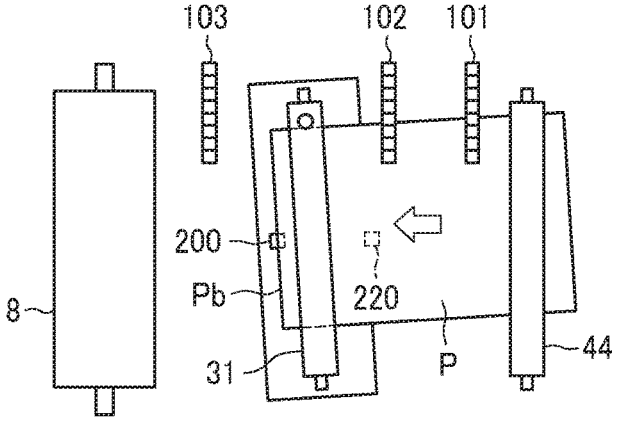
FIG. 11A is a plan view illustrating movement of the sheet conveying device according to an embodiment of this disclosure.
Figure 11B:
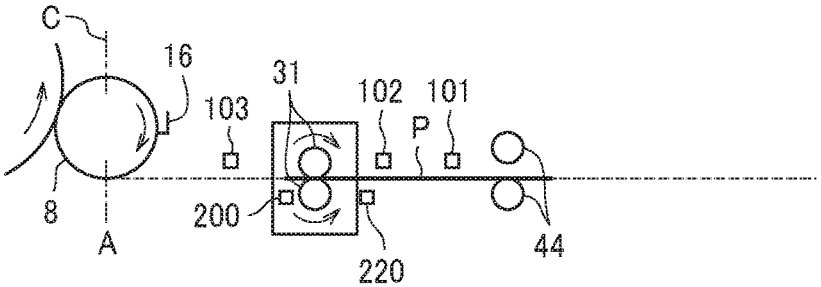
FIG. 11B is a side view illustrating the movement of the sheet conveying device of FIG. 11A.

Then, the leading end portion Pb of the sheet P is detected by the upstream side leading end detection sensor 220. Then, as the rollers of the pair of sheet gripping rollers 31 contact with each other based on the detection timing of the upstream side leading end detection sensor 220, the pair of sheet gripping rollers 31 starts rotation to convey the sheet P. Thereafter, as illustrated in FIGS. 11A and 11B, the sheet P is picked up by the pair of sheet gripping rollers 31 that faces the sheet P, so that the sheet P is conveyed while being gripped by the pair of sheet gripping rollers 31. It is to be noted that, at the moment the pair of sheet gripping rollers 31 receives (grips) the sheet P, the rollers of the pair of sheet conveying rollers 44 disposed upstream from the pair of sheet gripping rollers 31 in the sheet conveying direction are separated.

Further, as illustrated in FIGS. 11A and 11B, as the sheet P is conveyed by the pair of sheet gripping rollers 31 and the leading end Pb of the sheet P reaches the position of the downstream side leading end detection sensor 200, the downstream side leading end detection sensor 200 detects the leading end Pb of the sheet P (step S3 in the flowchart of FIG. 15). According to this operation, the timing at which the leading end Pb of the sheet P reaches the downstream side leading end detection sensor 200 is detected. Then, based on the detection information of the downstream side leading end detection sensor 200 and the detection information of the home position sensor 80 of the upstream side transfer cylinder 8, the target reception timing calculator 24 (see FIG. 6) calculates the target reception timing of the sheet P to the upstream side transfer cylinder 8, so that the target reception timing of the sheet P is set (step S4 in the flowchart of FIG. 15).

Figure 12A:
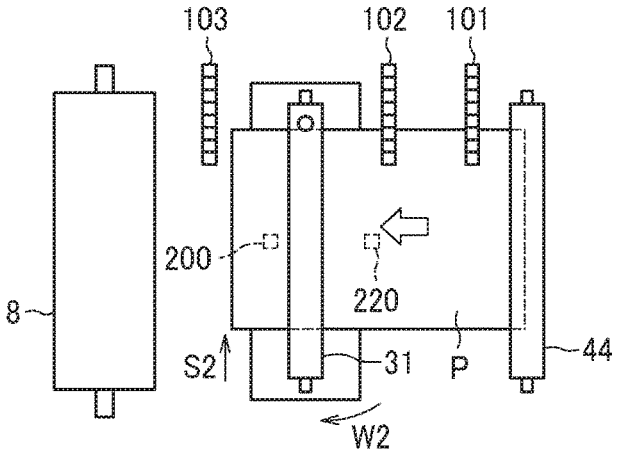
FIG. 12A is a plan view illustrating movement of the sheet conveying device according to an embodiment of this disclosure.
Figure 12B:
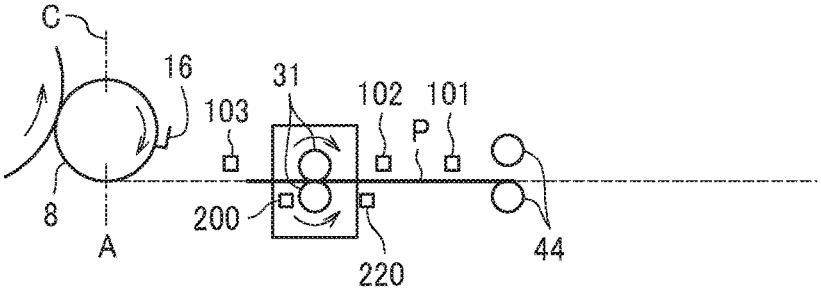
FIG. 12B is a side view illustrating the movement of the sheet conveying device of FIG. 12A.

Thereafter, as illustrated in FIGS. 12A and 12B, while gripping and conveying the sheet P, the pair of sheet gripping rollers 31 performs an adjustment operation to move in directions (i.e., the direction indicated by arrow S2 and the direction indicated by arrow W2 in FIG. 12A) that are opposite to the directions in which the pair of sheet gripping rollers 31 moves in the pick up operation (step S5 in the flowchart of FIG. 15). As a result, a "primary correction" in which the lateral displacement of the sheet P and the angular displacement of the sheet P are corrected is performed.

It is to be noted that, in the flowchart of FIG. 15, the adjustment operation (i.e., the primary correction) performed by the pair of sheet gripping rollers 31 in step S5 is described in the order after detection of the position of the leading end of the sheet detected by the downstream side leading end detection sensor 200 in step S3. However, the adjustment operation (i.e., step S5) may be performed prior to the detection of the position of the leading end of the sheet detected by the downstream side leading end detection sensor 200 (i.e., step S3) immediately after the pick up operation (i.e., step S2).

Further, as illustrated in FIGS. 13A and 13B, when the leading end portion Pb of the sheet P reaches the third CIS 103, a "second position detection" in which the second CIS 102 and the third CIS 103 detect the position of the side edge Pa of the sheet P for the second time is performed (step S6 in the flowchart of FIG. 15). Based on the position information detected by the second CIS 102 and the third CIS 103, the angular and lateral displacement amounts of the sheet P are calculated by the positional deviation amount calculator 21. Then, based on the calculated angular and lateral displacement amounts of the sheet P, the lateral drive motor 62 is controlled to move the pair of sheet gripping rollers 31 in the width direction (i.e., in a direction indicated by arrow S3 or in a direction indicated by arrow S4 in FIG. 13A) and the angular drive motor 63 is controlled to rotate the pair of sheet gripping rollers 31 in the rotation direction within a plane of sheet conveyance (i.e., in a direction indicated by arrow W3 or in a direction indicated by arrow W4 in FIG. 13A). By so doing, a "secondary correction" in which the angular and lateral displacements of the sheet P are corrected is performed (step S7 in the flowchart of FIG. 15).

As described above, by detecting the angular and lateral displacements of the sheet P (i.e., the second position detection) even after the adjustment operation (i.e., the primary correction) and correcting the angular and lateral displacements of the sheet P based on the detection results (i.e., the secondary correction), the angular and lateral displacements of the sheet P that are generated while the sheet P is being conveyed by the pair of sheet gripping rollers 31 is eliminated. Further, detection of the angular and lateral displacements of the sheet P after completion of the adjustment operation (i.e., the second position detection) may be performed multiple times at predetermined intervals during a period that the sheet P is passing by the second CIS 102 and the third CIS 103. Therefore, by performing the detection of the angular and lateral displacements of a sheet (i.e., the second position detection) for multiple times and performing the correction of the angular and lateral displacements of the sheet P (i.e., the secondary correction) each time the above-described detection is performed, the sheet P is conveyed with higher accuracy.

However, when the above-described correction of the angular and lateral displacements of the sheet (i.e., the secondary correction) is performed after the setting of the target reception timing of the sheet P, the position of the sheet in the sheet conveying direction changes due to the correction of the angular and lateral displacements of the sheet. Therefore, in a case in which the sheet having the change of the position in the sheet conveying direction is conveyed at the same conveying speed, the timing of arrival of the sheet to the sheet receiving position A also changes. As a result, the timing at which the sheet P reaches the sheet receiving position A is shifted from the timing at which the gripper 16 of the upstream side transfer cylinder 8 reaches the sheet receiving position A. Therefore, it is likely that the gripper 16 does not grip the sheet P accurately.

In order to address this inconvenience, the conveyance rotation speed of the pair of sheet gripping rollers 31 that conveys the sheet P is changed. By so doing, the conveying speed of the sheet P is adjusted to synchronize with arrival of the gripper 16 to the sheet receiving position A. However, in this method, when the conveyance rotation speed of the pair of sheet gripping rollers 31 is changed, slippage occurs between the sheet P and the pair of sheet gripping rollers 31. Due to this slippage, it is likely that the sheet conveyance timing of the sheet P is not adjusted with high accuracy.

Figure 23:
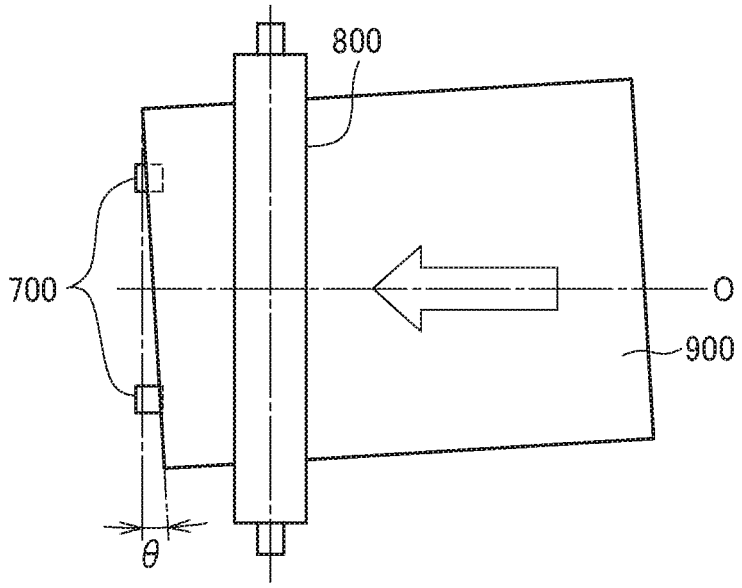
FIG. 23 is a plan view of a comparative sheet conveying device.
Figure 24:
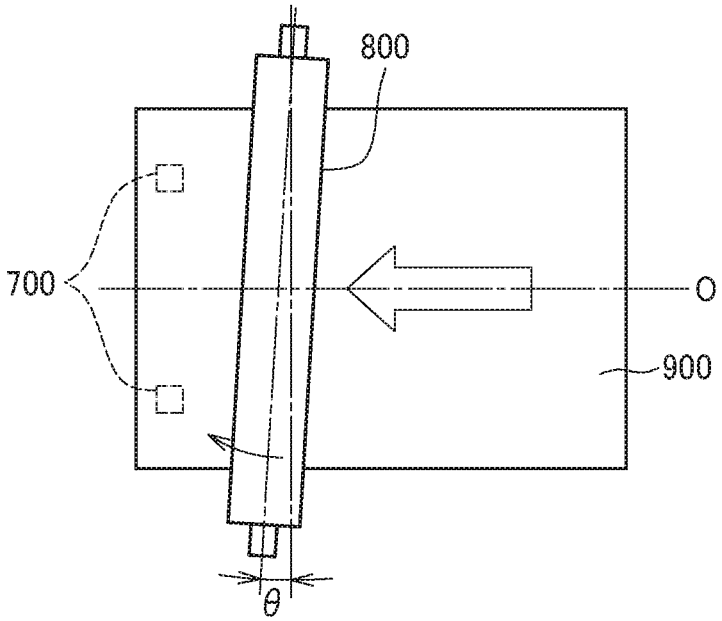
FIG. 24 is a plan view of the comparative sheet conveying device.

Specifically, as illustrated in FIG. 23, a comparative sheet conveying device detects the leading end of a sheet 900 by a pair of angular displacement detection sensor 700 aligned in a direction perpendicular to a sheet conveying direction of the sheet 900 (i.e., the direction indicated by arrow O), so that an angular displacement amount θ of the sheet 900 is calculated based on the detection result of the pair of angular displacement detection sensor 700. Then, as illustrated in FIG. 24, by rotating a pair of sheet conveying rollers 800 that functions as a pair of registration rollers according to the calculated angular displacement amount θ, the positional deviation of the sheet 900 (i.e., the angular displacement amount of the sheet 900) is corrected.

When the positional deviation of the sheet 900 is corrected as described above while the sheet 900 is being conveyed, the position of the leading end of the sheet 900 changes, and therefore an amount of time that the leading end of the sheet 900 reaches a predetermined target position varies. Consequently, if the sheet 900 is conveyed at a predetermined conveying speed of the sheet 900, the timing at which the sheet 900 reaches the target position is changed, which causes an inconvenience, for example, that the sheet 900 cannot be conveyed with high accuracy.

In order to avoid the change of the timing at which a sheet reaches the target position caused by correction of the positional deviation of the sheet, the comparative sheet conveying device calculates the position of the leading end of the sheet 900 after the correction of the positional deviation of the sheet 900 based on the positional deviation amount of the sheet 900, and the conveying speed of the sheet is adjusted based on the calculation result.

In order to avoid this inconvenience, in the present embodiment, when the angular and lateral displacements of the sheet P (i.e., the secondary correction) is performed after the target reception timing has been set (i.e., each time that the correction of positional deviation of the sheet P is performed), the rotation speed of the upstream side transfer cylinder 8 that receives the sheet P is changed (adjusted) based on the amount of correction of the angular and lateral displacements of the sheet P (step S8 in the flowchart of FIG. 15). By contrast, the pair of sheet gripping rollers 31 is controlled to rotate at a predetermined conveyance rotation speed (i.e., at a constant conveyance rotation speed) based on the detection information of the rotary encoder 96 (see FIG. 3) that is mounted on the pair of sheet gripping rollers 31.

As described above, by correcting the rotation speed of the upstream side transfer cylinder 8 based on the correction amount of positional deviation of the sheet, the gripper 16 of the upstream side transfer cylinder 8 reaches the sheet receiving position A in synchronization with arrival of the sheet P to the sheet receiving position A (step S9 in the flowchart of FIG. 15), as illustrated in FIGS. 14A and 14B. Accordingly, the gripper 16 receives (grips) the sheet P reliably. Then, the rollers of the pair of sheet gripping rollers 31 separate from each other when the sheet P arrives at the sheet receiving position A. Consequently, conveyance of the sheet P by the pair of sheet gripping rollers 31 completes.

It is to be noted that, in a case in which no angular and lateral displacements of the sheet P are performed after completion of setting of the target reception timing, the timing of arrival of the sheet P to the sheet receiving position A does not basically change. Therefore, the rotation speed of the upstream side transfer cylinder 8 that corresponds to correction of the positional deviation of the sheet P is not performed.

Figure 16:
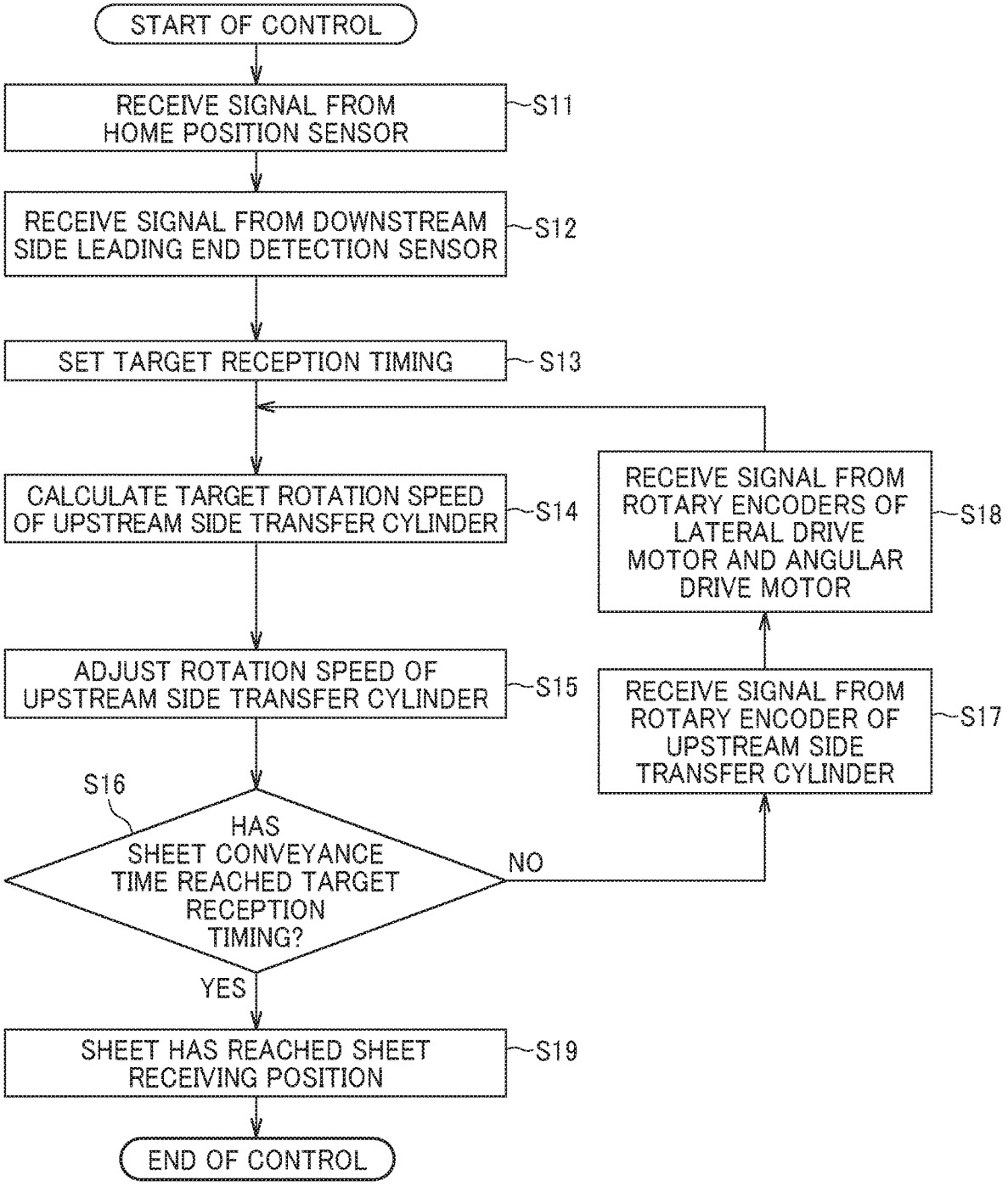
FIG. 16 is a flowchart of a rotation speed control according to an embodiment of this disclosure.

Now, a description is given of a method of controlling the rotation speed of the upstream side transfer cylinder 8, with reference to a flowchart of FIG. 16.

As illustrated in FIG. 16, when the control of the rotation speed of the upstream side transfer cylinder 8 is started, it is confirmed that the gripper 16 is located at the rotation reference position C, based on the detection result of the home position sensor 80 of the upstream side transfer cylinder 8 before the target reception timing is set (step S11 of the flowchart in FIG. 16). Then, as described above, the downstream side leading end detection sensor 200 detects the leading end of the sheet P (step S12 in the flowchart of FIG. 16). Then, the target reception timing is set based on the detection information of the downstream side leading end detection sensor 200 and based on the detection result of the home position sensor 80 of the upstream side transfer cylinder 8 (step S13 in the flowchart of FIG. 16).

Thereafter, the target rotation speed of the upstream side transfer cylinder 8 is calculated in accordance with the target reception timing that has been set in step S13 (step S14 in the flowchart of FIG. 16).

It is to be noted that the target rotation speed of the upstream side transfer cylinder 8 may be calculated by the target reception timing calculator 24 or another calculating unit.

Then, based on the calculated target rotation speed of the pair of sheet gripping rollers 31, the rotation speed of the upstream side transfer cylinder 8 is controlled (step S15 in the flowchart of FIG. 16). In the present embodiment, the rotation speed of the upstream side transfer cylinder 8 is managed based on a signal from the rotary encoder 82 mounted on the upstream side transfer cylinder 8. Accordingly, when it is determined that the rotation speed of the upstream side transfer cylinder 8 is faster or slower than the target rotation speed of the upstream side transfer cylinder 8, the rotation speed controller 25 that functions as circuitry acquires the signal from rotary encoder 82 (step S17 in the flowchart of FIG. 16).

Further, when the correction of the position deviation of the sheet P (i.e., the angular and lateral displacements of the sheet P) by the pair of sheet gripping rollers 31 is performed after the setting of the target reception timing at which the upstream side transfer cylinder 8 receives the sheet P, the rotation speed of the upstream side transfer cylinder 8 is changed based on the amount of correction of the angular and lateral displacements of the sheet P along this correction of positional deviation of the sheet P. The amount of correction of the angular and lateral displacements of the sheet P corresponds to the drive position (i.e., the drive amount and the drive direction) in which the pair of sheet gripping rollers 31 moves in the width direction or rotates in the rotation direction within a plane of sheet conveyance when correcting the angular and lateral displacements of the sheet. Therefore, in the present embodiment, the rotation speed controller 25 acquires a signal from the rotary encoder 57 that detects the drive amount and the driving direction of the pair of sheet gripping rollers 31 in the width direction and a signal from the rotary encoder 58 that detects the drive amount and the driving direction of the pair of sheet gripping rollers 31 in the rotation direction within a plane of sheet conveyance of the sheet (step S18 in the flowchart of FIG. 16). Then, the target rotation speed of the upstream side transfer cylinder 8 is calculated based on the target reception timing and the signals from the rotary encoder 82, the rotary encoder 57, and the rotary encoder 58 (step S14 in the flowchart of FIG. 16). Then, based on the recalculated target rotation speed of the pair of sheet gripping rollers 31, the rotation speed of the upstream side transfer cylinder 8 is controlled (step S15 in the flowchart of FIG. 16). Thereafter, the control of the rotation speed of the upstream side transfer cylinder 8 as described above is performed until the sheet conveyance time of the pair of sheet gripping rollers 31 reaches the target reception timing of the upstream side transfer cylinder 8 (step S16 in the flowchart of FIG. 16). Then, after the sheet conveyance time of the pair of sheet gripping rollers 31 has reached the target reception timing of the upstream side transfer cylinder 8, the gripper 16 reaches the sheet receiving position A in synchronization with arrival of the sheet P at the sheet receiving position A (step S19 in the flowchart of FIG. 16). As a result, the gripper 16 grips the sheet P timely and reliably.

Figure 17:
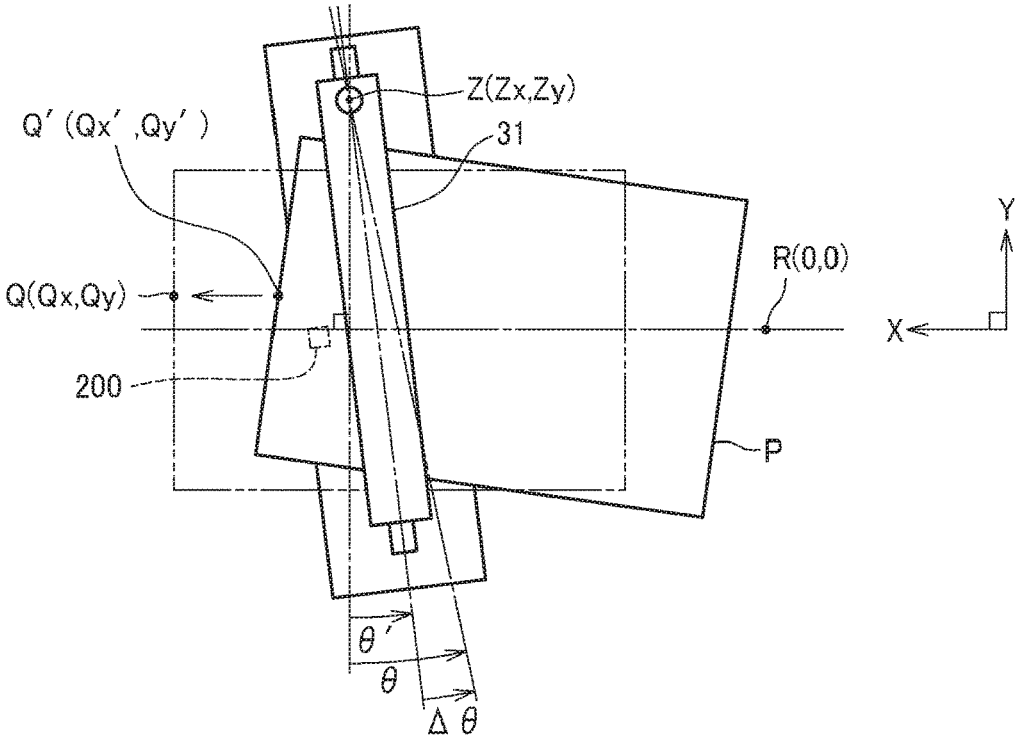
FIG. 17 is a diagram for explaining a method of calculating an amount of position change of a sheet according to correction of angular and lateral displacements of the sheet.

Now, a description is given of a method of calculating the amount of position change of a sheet along with correction of the angular and lateral displacements of the sheet with reference to FIG. 17.

FIG. 17 is a diagram for explaining a method of calculating the amount of position change of a sheet according to correction of angular and lateral displacements of the sheet. In FIG. 17, a point Z indicates a position of the rotation center (i.e., the support shaft 73) within a plane of sheet conveyance when the pair of sheet gripping rollers 31 is located at the home position, a point R indicates a measurement reference point, a point Q indicates a position of the leading end of the sheet when a time t has elapsed after the downstream side leading end detection sensor 200 has detected the leading end of the sheet, and a point Q' indicates a position of the leading end of the sheet when the angular and lateral displacements of the sheet is corrected at a timing (i.e., a time t−1) which is one previous timing before the time t. Further, in FIG. 17, letters in parentheses indicate are respective X coordinates and Y coordinates of the points Z, Q and Q' relative to the point R that functions as the measurement reference point, where the sheet conveying direction is an X direction and a direction perpendicular to the sheet conveying direction is a Y direction. Further, "θ" indicates an angle of inclination of the pair of sheet gripping rollers 31 from the home position (i.e., an angle of rotation within a plane of sheet conveyance of the sheet) when the leading end of the sheet reaches the position of the point Q, and "θ'" indicates an angle of inclination of the pair of sheet gripping rollers 31 from the home position (i.e., an angle of rotation of the pair of sheet gripping rollers 31 within a plane of sheet conveyance) when the leading end of the sheet reaches the position of the point Q'. "Δθ" indicates the difference between the angle of inclination θ and the angle of inclination θ'.

As described above, in a case in which the position of the leading end of the sheet P changes along with the correction of angular and lateral displacements of the sheet P, the position coordinates (Qx, Qy) of a leading end position Q at the time t are calculated using the following equations, which are Equation 1 and Equation 2).

$$Qx=\cos(\Delta\theta)(Qx'-Zx)-\sin(\Delta\theta)(Qy'-Zy)+Zx+Xp \quad \text{Equation 1.}$$

$$Qy=\sin(\Delta\theta)(Qx'-Zx)+\cos(\Delta\theta)(Qy'-Zy)+Zy+Yp+Ys \quad \text{Equation 2.}$$

"Xp" in Equation 1 is an X direction component of a conveyance distance of the sheet P in which the sheet P is conveyed until the one previous timing (i.e., the time t−1) before the time t. "Yp" in Equation 2 is a Y direction component of the conveyance distance of the sheet P. When a conveyance distance of the sheet P in which the sheet P is conveyed by the pair of sheet gripping rollers 31 until the time t−1 (that is, a conveyance distance of the sheet P in a direction perpendicular to the roller shaft) is indicated as "Fp", Xp and Yp are expressed by the following Equations 3 and 4. Further, "Ys" in Equation 2 is an amount of movement of the sheet P in the width direction from the point Q' to the point Q (i.e., an amount of movement in a Y direction).

$$Xp=\cos(\theta')Fp \quad \text{Equation 3.}$$

$$Yp=\sin(\theta')Fp \quad \text{Equation 4.}$$

Therefore, by using the above Equations 1 to 4, the position coordinates (Qx, Qy) of the leading position Q at the time t is calculated.

Then, by subtracting an X coordinate Vx of the sheet leading end position after the time t has elapsed without the correction of the angular and lateral displacements of the sheet, from the calculated X coordinate Qx, the position change amount G of the leading end of the sheet according to the correction of the angular and lateral displacements of the sheet is calculated (see Equation 5 below). Then, by calculating a period of time (i.e., the target reception timing) until which the sheet P reaches the sheet receiving position A based on the position change amount G calculated as described above and by adjusting the rotation speed of the upstream side transfer cylinder 8 based on the calculated target reception timing, the sheet P is conveyed to the upstream side transfer cylinder 8 (specifically, the gripper 16) at a predetermined target reception timing.

$$G=Qx-Vx \quad \text{Equation 5.}$$

As described above, in the sheet conveying device according to the present embodiment of this disclosure, even if the position of the sheet in the sheet conveying direction changes along with the correction of positional deviation of the sheet (i.e., the correction of angular and lateral displacements of the sheet), each time the correction of the angular and lateral displacements of the sheet is performed, the rotation speed of the upstream side transfer cylinder 8 is changed (adjusted) based on the amount of correction of the angular and lateral displacements of the sheet (that is, the amount of positional change of the sheet P in the width direction and the amount of positional change of the sheet P in the rotation direction within a plane of sheet conveyance). By so doing, the gripper 16 reaches the sheet receiving position A in synchronization with arrival of the sheet P to the sheet receiving position A.

Further, not by correcting the conveying speed of the pair of sheet gripping rollers 31 from which the sheet P is conveyed but by correcting the rotation speed of the upstream side transfer cylinder 8 to which the sheet P is conveyed, occurrence of slippage between the pair of sheet gripping rollers 31 and the sheet P is prevented, and therefore the sheet P is conveyed to the upstream side transfer cylinder 8 with accuracy. As a result, the positional deviation of the image with respect to the sheet is prevented with high accuracy, and the print quality is enhanced.

Furthermore, when the duplex printing is performed to a sheet, the positional deviation of an image to the front face of the sheet and an image to the back face of the sheet is adjusted, and therefore the relative positional deviation of the image on the front face of the sheet and the image on the back face of the sheet is adjusted.

It is to be noted that, in the present embodiment, the correction of the angular and lateral displacements of the sheet and the change of the rotation speed of the upstream side transfer cylinder 8 are performed each time the position of the sheet is detected. However, the method of correcting the displacements of the sheet and changing the conveying speed of the sheet is not limited thereto. For example, firstly the angular and lateral displacements of the sheet may be corrected based on some detection results of the position information of the sheet detected for multiple times, and then the rotation speed of the upstream side transfer cylinder 8 may be changed according to the correction of angular and lateral displacements of the sheet. That is, each of the number of times to perform correction of angular and lateral displacements of the sheet and the number of times to change the rotation speed of the upstream side transfer cylinder 8 may be smaller than the number of times to detect the position of the sheet.

Figure 18:
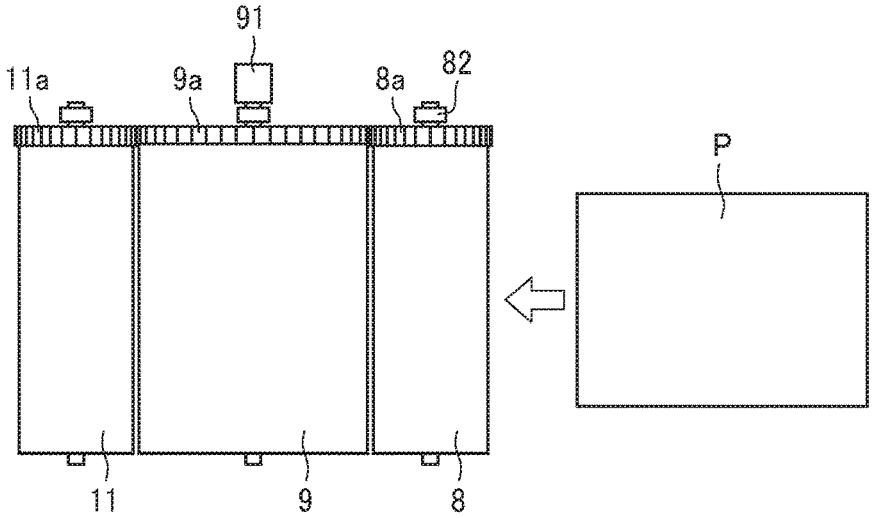
FIG. 18 is a diagram illustrating an upstream side transfer cylinder, a sheet bearing drum, and a downstream side transfer cylinder that are coupled together to be interlocked.

Further, in the present embodiment, the control of the rotation speed of the upstream side transfer cylinder 8 is performed based on the detection result of the rotary encoder 82 that is mounted on the upstream side transfer cylinder 8. However, as in the configuration illustrated in FIG. 18, the rotation speed of the upstream side transfer cylinder 8 may be indirectly controlled by controlling the drive motor 91 that is provided on the sheet bearing drum 9 that interlocks with the upstream side transfer cylinder 8. In the configuration illustrated in FIG. 18, the upstream side transfer cylinder 8, the sheet bearing drum 9, and the downstream side transfer cylinder 11 are coupled via respective gears 8*a*, 9*a*, and 11*a*. Specifically, the gear 8*a* is mounted on one end of the upstream side transfer cylinder 8, the gear 9*a* is mounted on one end of the sheet bearing drum 9, and the gear 11*a* is mounted on one end of the downstream side transfer cylinder 11. The upstream side transfer cylinder 8, the sheet bearing drum 9, and the downstream side transfer cylinder 11 are interlocked by the drive motor 91 that is mounted on the sheet bearing drum 9. Specifically, since the rotation speed of the upstream side transfer cylinder 8 is determined according to the rotation speed of the sheet bearing drum 9, the rotation speed of the upstream side transfer cylinder 8 may be indirectly controlled by controlling the drive motor 91 that is mounted on the sheet bearing drum 9 based on detection result of the rotary encoder 82 that is mounted on the upstream side transfer cylinder 8.

In the present embodiment, the downstream side leading end detection sensor 200 is driven together (integrally) with the pair of sheet gripping rollers 31 but the configuration of the downstream side leading end detection sensor 200 is not limited to this configuration. For example, the downstream side leading end detection sensor 200 may be driven separately from the pair of sheet gripping rollers 31. However, in that case, the leading end detection position of the downstream side leading end detection sensor 200 may vary according to the degree of angular displacement of the sheet.

Therefore, when the angular and lateral displacements of the sheet are corrected by the adjustment operation performed by the pair of sheet gripping rollers 31 (i.e., the primary correction) after the position of the leading end of the sheet is detected by the downstream side leading end detection sensor 200 (in other words, after the target reception timing is set), the target reception timing varies according to the degree of movement of the pair of sheet gripping rollers 31 in the adjustment operation (i.e., the degree of angular displacement amount of the sheet). Therefore, in order to address this adverse effect to the target reception timing due to correction of positional deviation of the sheet P (i.e., the primary correction), the rotation speed of the upstream side transfer cylinder 8 is changed according to the adjustment operation (i.e., the primary correction) or the downstream side leading end detection sensor 200 detects the sheet conveyance timing of the sheet P is detected after completion of the adjustment operation.

By contrast, in the present embodiment, the downstream side leading end detection sensor 200 is driven together (integrally) with the pair of sheet gripping rollers 31. Therefore, the sheet is detected each time in a state in which the sheet is located facing the downstream side leading end detection sensor 200 (that is, each time in the same posture). Consequently, the leading end detection position of the downstream side leading end detection sensor 200 may not vary according to the degree of angular displacement of the sheet. Therefore, the target reception timing may not be susceptible to the variation in the leading end detection position.

In addition, the downstream side leading end detection sensor 200 is returned to the same position (i.e., the home position) each time along with the adjustment operation performed by the pair of sheet gripping rollers 31. Therefore, the distance from the downstream side leading end detection sensor 200 to the sheet receiving position A remains the same distance each time. Accordingly, the target reception timing of the sheet is not susceptible to the change in the distance from the downstream side leading end detection sensor 200 to the sheet receiving position A.

As described above, in the present embodiment, the downstream side leading end detection sensor 200 is driven together with the pair of sheet gripping rollers 31, so that no various adverse effects are generated when the sensors are fixed. Therefore, the rotation speed of the upstream side transfer cylinder 8 may not be changed according to the adjustment operation (i.e., the primary correction) performed by the pair of sheet gripping rollers 31. Accordingly, the rotation speed of the upstream side transfer cylinder 8 alone is changed according to correction of positional deviation of the sheet after the adjustment operation (i.e., the secondary correction). In addition, since the correction of positional deviation of the sheet after the adjustment operation (i.e., the secondary correction) is performed to correct fine positional deviation performed after the previous positional deviation has been corrected once, the rotation speed of the upstream side transfer cylinder 8 may be changed slightly along with this correction. Accordingly, even when the sheet is conveyed at high speed or even when the distance of conveyance of the sheet to the sheet receiving position A is short, the secondary correction is performed sufficiently.

Further, since the target reception timing is not affected by the adjustment operation to correct the positional deviation of the sheet, the downstream side leading end detection sensor 200 obtains a time to detect the sheet conveyance timing of the sheet before the adjustment operation is completed (in other words, before the start of the adjustment operation or in the middle of the adjustment operation). Therefore, the target reception timing is set at an early stage, and sufficient control time of the rotation speed of the upstream side transfer cylinder 8 to be performed later is secured. As a result, the accuracy in control is enhanced.

It is to be noted that, in the present embodiment, the downstream side leading end detection sensor 200 is disposed on the downstream side of the pair of sheet gripping rollers 31. However, in order to obtain the effect by driving the downstream side leading end detection sensor 200 together with the pair of sheet gripping rollers 31, the downstream side leading end detection sensor 200 may be disposed upstream from the pair of sheet gripping rollers 31 in the sheet conveying direction.

Further, in the present embodiment, the correction amounts of angular and lateral displacements of the sheet are obtained indirectly from information of the rotary encoders 57 and 58 (that function as drive position detectors) that detect the amount of movement of the pair of sheet gripping rollers 31 in the width direction and the amount of rotation of the pair of sheet gripping rollers 31 in the rotation direction within a plane of sheet conveyance. However, the correction amounts of angular and lateral displacements of the sheet may also be obtained by calculation based on the CIS(s) that directly detect the position of the sheet. However, the CIS (or the CISs) has a large amount of information and a large load including communication and arithmetic processing. Therefore, the period from the time of detection of the position of the sheet to the time of the change of the rotation speed of the upstream side transfer cylinder 8 may become longer.

By contrast, when calculating the correction amount of angular and lateral displacements of the sheet indirectly based on the information from the rotary encoders (i.e., the rotary encoders 57 and 58), the amount of load such as communication and arithmetic processing is reduced. Therefore, the change of the conveying speed of the sheet is started at an earlier timing. Therefore, even in a configuration in which the conveying speed of the sheet is a relatively high speed or the distance of sheet conveyance to the sheet receiving position A is relatively short, the control time of the conveying speed of the upstream side transfer cylinder 8 is secured and the sheet is conveyed with high accuracy.

Figure 19:
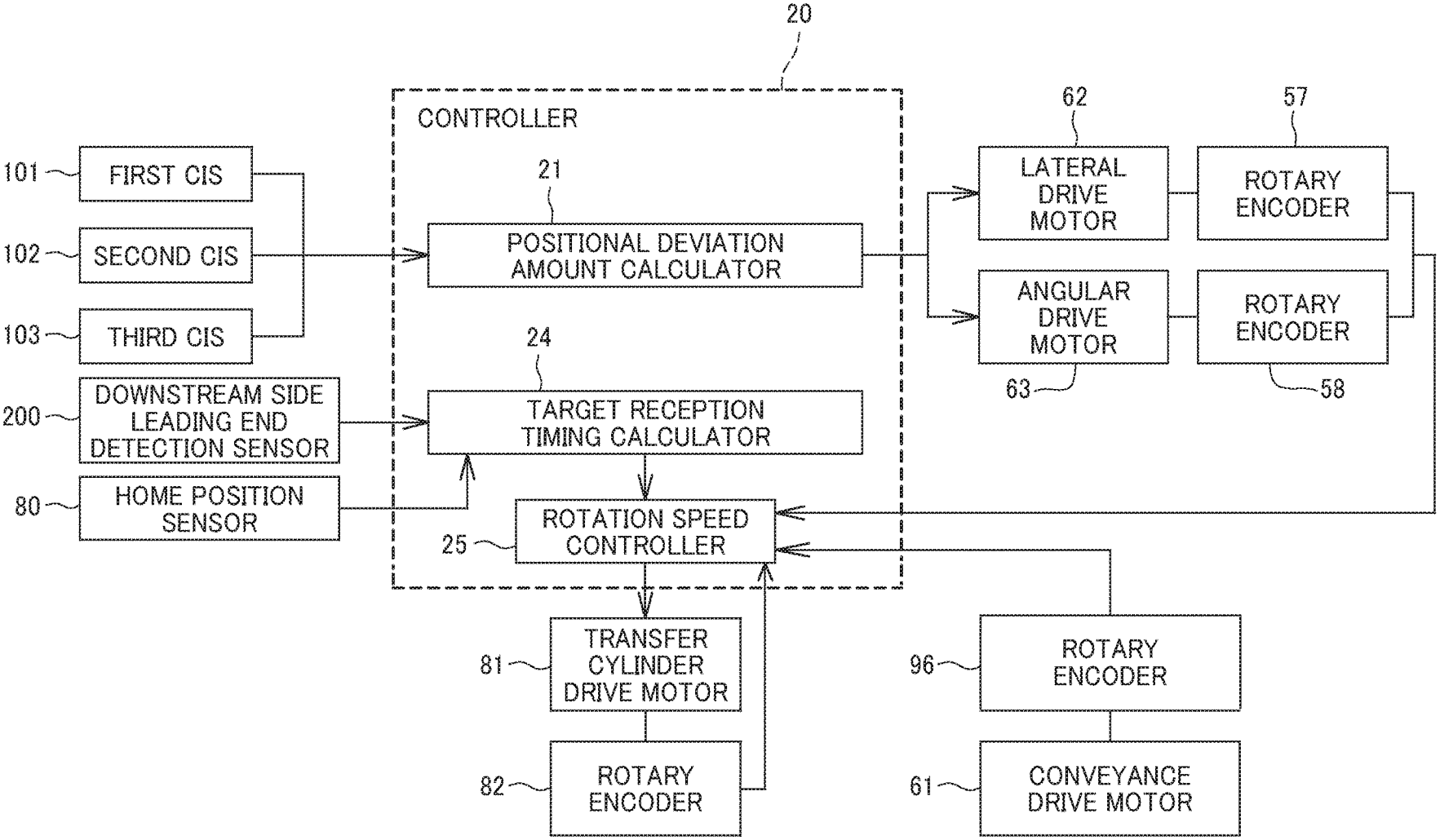
FIG. 19 is a block diagram illustrating a control system of a sheet conveying device according another embodiment of this disclosure.
Figure 20:
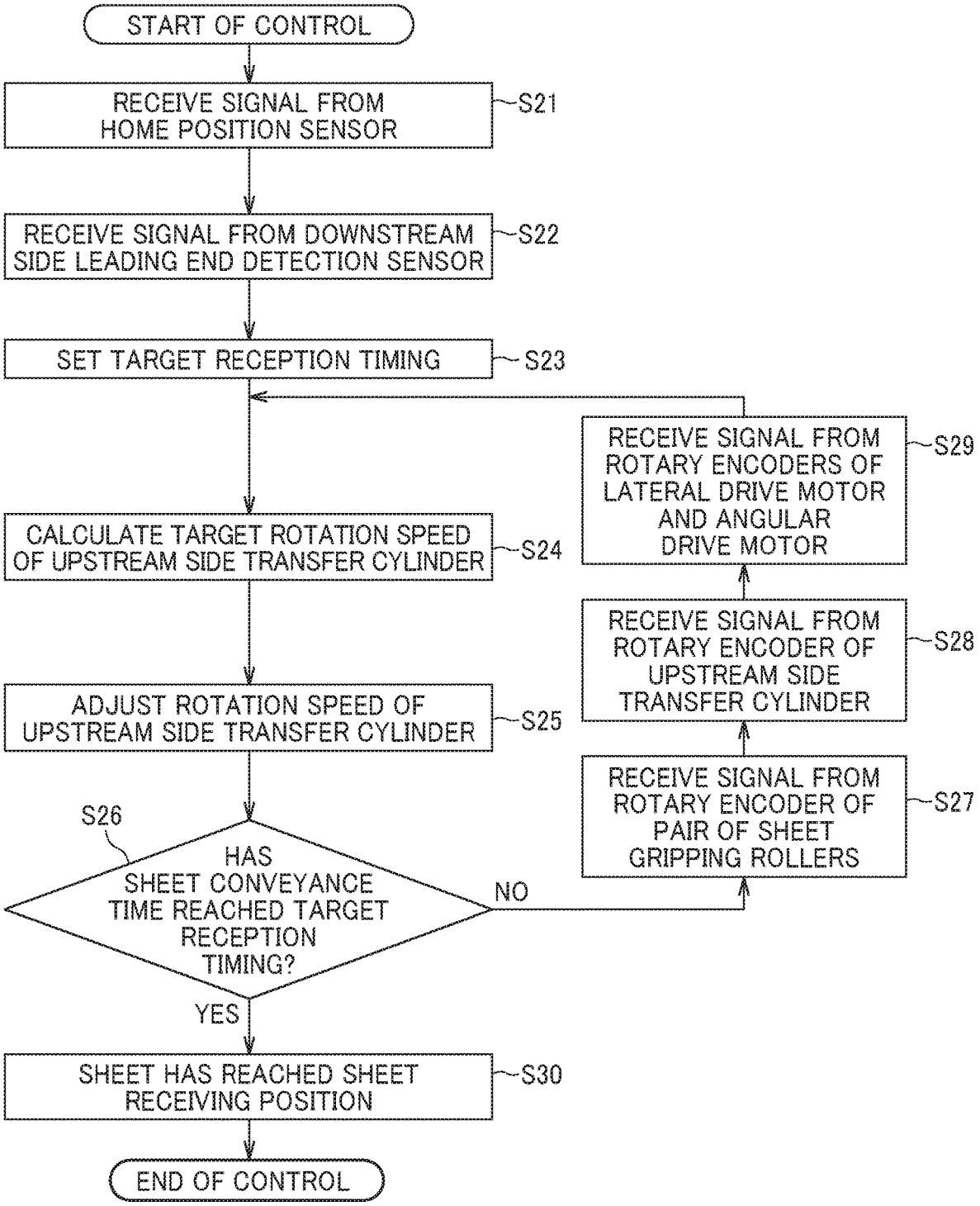
FIG. 20 is a flowchart of a sheet conveying operation according to another embodiment of this disclosure.

Now, a description is given of the sheet conveying device 7 according to another embodiment of this disclosure with reference to FIGS. 19 and 20.

FIG. 19 is a block diagram illustrating a control system of the sheet conveying device 7 according another embodiment of this disclosure. FIG. 20 is a flowchart of the sheet conveying device 7 according to another embodiment of this disclosure.

The sheet conveying device 7 according to another embodiment illustrated in FIG. 19 basically has a configuration identical to the sheet conveying device 7 illustrated in FIG. 6. However, different from the sheet conveying device 7 illustrated in FIG. 6, the sheet conveying device 7 illustrated in FIG. 19 further includes a rotary encoder 96 that functions as a rotation speed detector to detect the conveyance rotation speed of the pair of sheet gripping rollers 31. As illustrated in FIG. 20, the flowchart includes an additional process (i.e., step S27) in which the controller 20 receives a signal from the rotary encoder 96.

Basically, the pair of sheet gripping rollers 31 is controlled to rotate at a constant speed. However, it is also conceivable that the conveyance rotation speed of the pair of sheet gripping rollers 31 changes for some reasons. In other words, the rotation speed controller 25 receives a signal from the rotary encoder 82 of the transfer cylinder drive motor 81, a signal from the rotary encoder 57 of the lateral drive motor 62 and the rotary encoder 58 of the angular drive motor 63, and a signal from the rotary encoder 96 of the conveyance drive motor 61 mounted on the pair of sheet gripping rollers 31. According to this configuration, in the flowchart of FIG. 20, in this case, the processes until the sheet conveyance time reaches the target reception timing of the sheet P (i.e., YES in step S16), that is, the first half processes (i.e., steps S11 through 16) and steps S17 and S18 in the flowchart of FIG. 16 are performed. Specifically, steps S21 through S26 in the flowchart of FIG. 20 perform the same processes as steps S11 through S16 in the flowchart of FIG. 16. Then, when the sheet conveyance time has not reached the target reception timing (i.e., NO in step S26), the process goes to step S27 at which the rotation speed controller 25 receives the signal from the rotary encoder 96 of the conveyance drive motor 61 mounted on the pair of sheet gripping rollers 31. Thereafter, steps S28 through S30 in the flowchart of FIG. 20 performs the same process as steps S17 through S19 in the flowchart of FIG. 16. Accordingly, detailed description of the overlapped processes, which are steps S21 through S26 and S28 through 30 are omitted.

In that case, as described above, even if the rotation speed of the upstream side transfer cylinder 8 is changed based on the amounts of the angular and lateral displacement corrections of the sheet P, the timing of conveyance of the sheet P and the timing of arrival of the gripper 16 on the upstream side transfer cylinder 8 may not meet.

In order to cause the timing of conveyance of the sheet P and the timing of arrival of the gripper 16 on the upstream side transfer cylinder 8 to meet with each other, in the present embodiment, the controller 20 adjusts the rotation speed of the upstream side transfer cylinder 8 based on a signal from the rotary encoder 96 of the pair of sheet gripping rollers 31 in addition to the signal from the rotary encoder 82 that detects the rotation speed of the upstream side transfer cylinder 8 and the signal from the respective rotary encoders 57 and 58 that detect the amount of movement of the pair of sheet gripping rollers 31 in the width direction and the amount of rotation of the pair of sheet gripping rollers 31 in the rotation direction within a plane of sheet conveyance, respectively. As a result, even if the conveyance rotation speed of the pair of sheet gripping rollers 31 is changed, the timing of conveyance of the sheet P and the timing of arrival of the gripper 16 on the upstream side transfer cylinder 8 are matched, and therefore the sheet P is conveyed with higher accuracy. As a result, even if the conveyance rotation speed of the pair of sheet gripping rollers 31 is changed, the timing of conveyance of the sheet P and the timing of arrival of the gripper 16 on the upstream side transfer cylinder 8 are matched, and therefore the sheet P is conveyed with higher accuracy.

Figure 21:
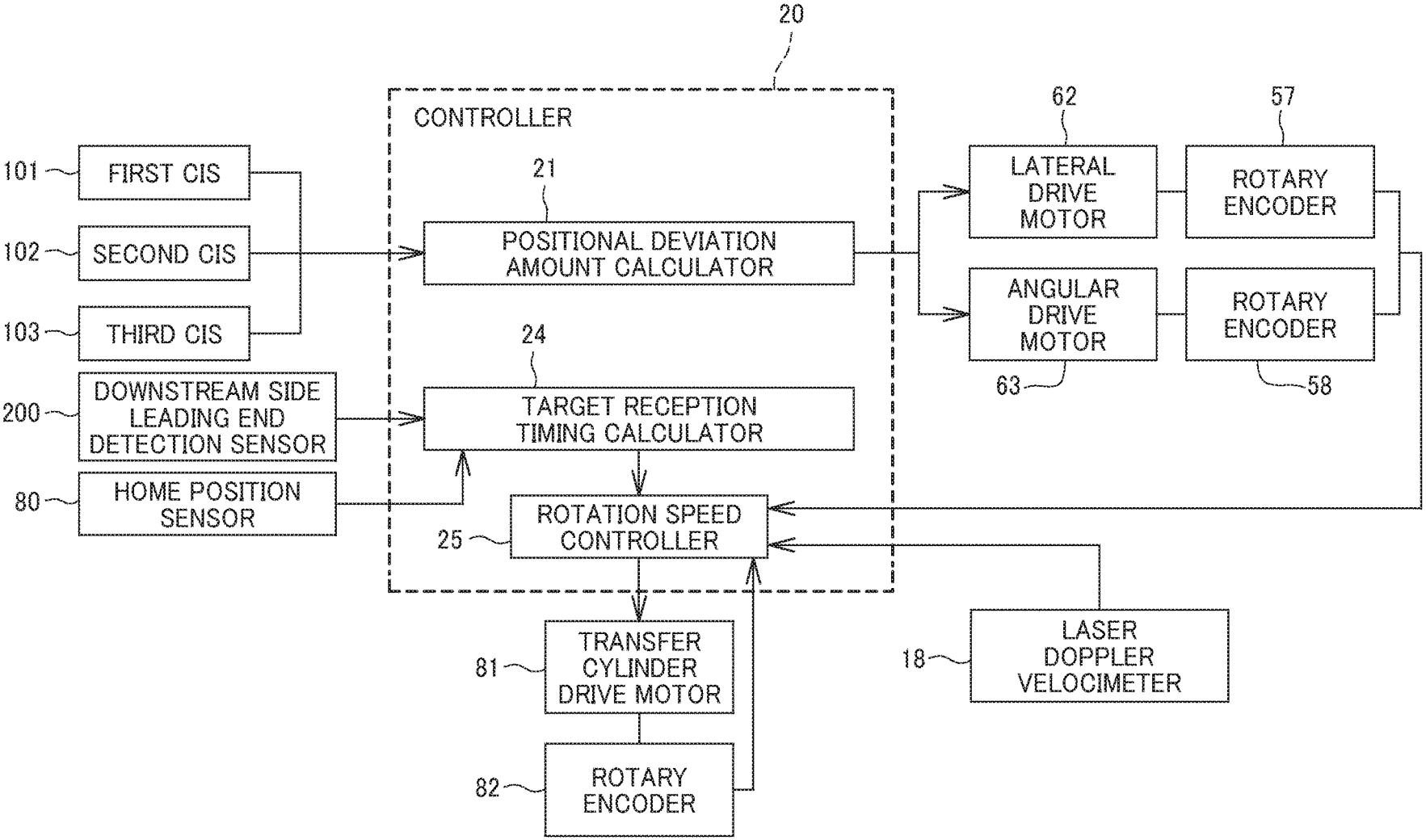
FIG. 21 is a block diagram illustrating a control system of a sheet conveying device according to yet another embodiment of this disclosure.
Figure 22:
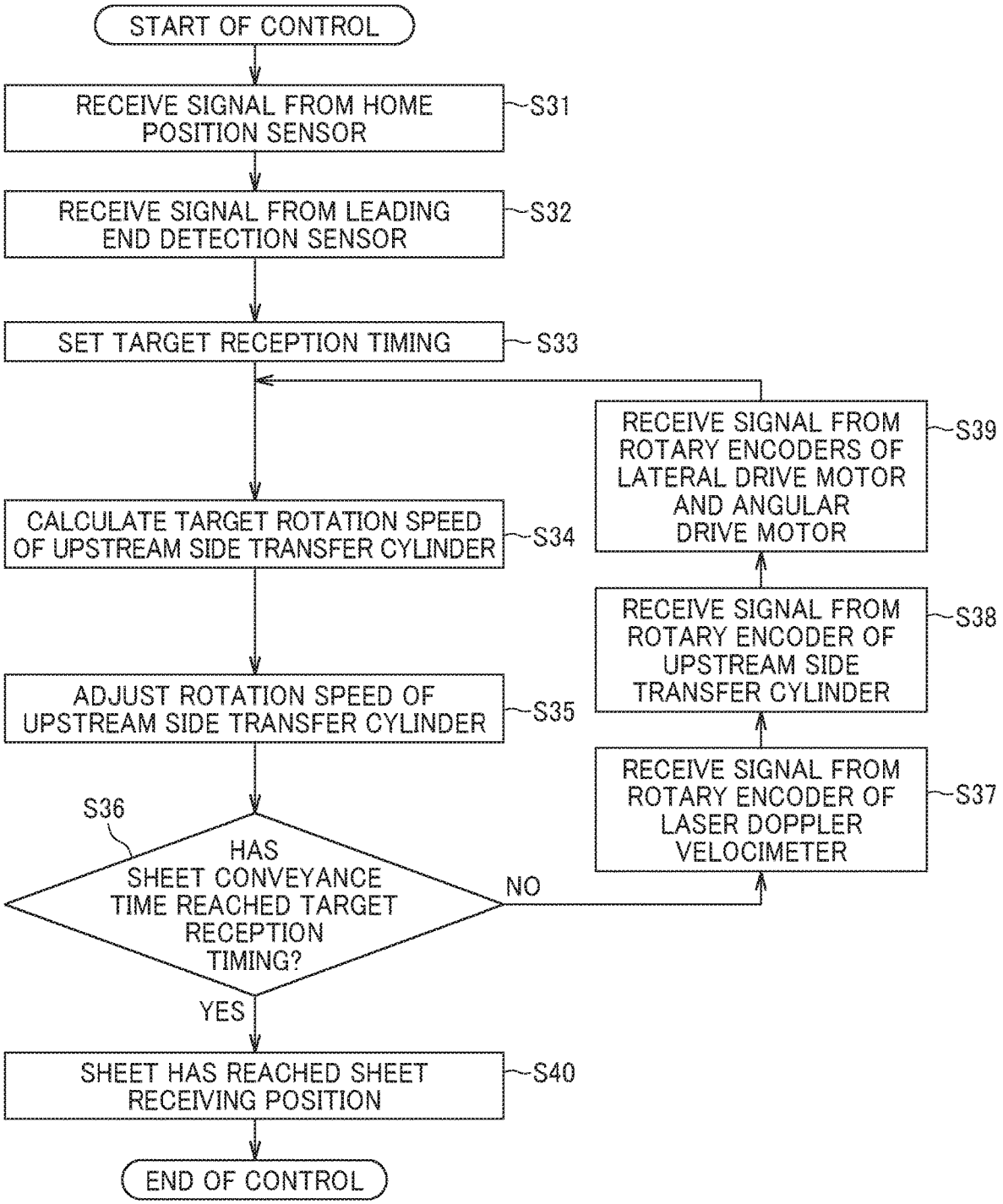
FIG. 22 is a flowchart of a sheet conveying operation according to yet another embodiment of this disclosure.

Now, a description is given of the sheet conveying device 7 according to yet another embodiment of this disclosure with reference to FIGS. 21 and 22.

FIG. 21 is a block diagram illustrating a control system of the sheet conveying device 7 according yet another embodiment of this disclosure. FIG. 22 is a flowchart of the sheet conveying device 7 according to yet another embodiment of this disclosure.

The sheet conveying device 7 according to yet another embodiment illustrated in FIG. 21 basically has a configuration identical to the sheet conveying device 7 illustrated in FIG. 6. However, different from the sheet conveying device 7 illustrated in FIG. 6 that includes the rotary encoder 96 and the conveyance drive motor 61, the sheet conveying device 7 illustrated in FIG. 21 includes a laser doppler velocimeter 18 that functions as a conveyance target medium speed detector to detect the conveying speed of the sheet P. The laser doppler velocimeter 18 is a non-contact type measuring instrument that directly measures the conveying speed of a conveyance target medium (i.e., the sheet P) by utilizing the Doppler effect of light. In other words, the rotation speed controller 25 receives a signal from the rotary encoder 82 of the transfer cylinder drive motor 81, a signal from the rotary encoder 57 of the lateral drive motor 62 and the rotary encoder 58 of the angular drive motor 63, and a signal from the laser doppler velocimeter 18. According to this configuration, in the flowchart of FIG. 22, in this case, the processes until the sheet conveyance time reaches the target reception timing of the sheet P (i.e., YES in step S16), that is, the first half processes (i.e., steps S11 through 16) and steps S17 and S18 in the flowchart of FIG. 16 are performed. Specifically, steps S31 through S36 in the flowchart of FIG. 22 perform the same processes as steps S11 through S16 in the flowchart of FIG. 16. Then, when the sheet conveyance time has not reached the target reception timing (i.e., NO in step S36), the process goes to step S37 at which the rotation speed controller 25 receives the signal from the laser doppler velocimeter 18. Thereafter, steps S38 through S40 in the flowchart of FIG. 22 performs the same process as steps S17 through S19 in the flowchart of FIG. 16. Accordingly, detailed description of the overlapped processes, which are steps S31 through S36 and S38 through 40 are omitted.

In the above-described embodiments, which are the sheet conveying device 7 illustrated in FIG. 19 and in the flowchart of FIG. 20, a signal from the rotary encoder 96 that detects the conveyance rotation speed of the pair of sheet gripping rollers 31 is obtained, so that the conveying speed of the sheet P is indirectly detected. However, in a case in which slippage occurs between the sheet P and the pair of sheet gripping rollers 31, the conveyance rotation speed of the pair of sheet gripping rollers 31 obtained by information from the rotary encoder 96 may not detect the conveying speed of the sheet P correctly.

Therefore, the sheet conveying device 7 according to the present embodiment, the rotary encoder 96 that detects the conveyance rotation speed of the pair of sheet gripping rollers 31 is replaced by the laser doppler velocimeter 18. By so doing, the rotation speed of the upstream side transfer cylinder 8 is controlled based on the conveying speed of the sheet P that is directly detected by the laser doppler velocimeter 18 (step S37 in FIG. 22). As a result, even if slippage occurs between the sheet P and the pair of sheet gripping rollers 31, the deviation of the sheet conveyance timing due to the slippage is prevented, and therefore the sheet P is conveyed with higher accuracy.

Although the embodiments of this disclosure have been described above, this disclosure is not limited to the above-described embodiments, and it is obvious that various modifications can be made without departing from the gist of this disclosure.

It is to be noted that, in the flowcharts of FIGS. 16, 20, and 22, a signal from the home position sensor 80 is received in order to set the target conveyance timing. However, the process is not limited thereto. For example, instead of a signal from the home position sensor 80, a signal from the rotary encoder 82 of the upstream side transfer cylinder 8 may be received. Even though the signal from the home position sensor 80 is not received, the position of the gripper 16 is confirmed based on the signal from the rotary encoder 82 of the upstream side transfer cylinder 8, thereby setting the target conveyance timing.

In the above-described embodiment, the receiving portion of the upstream side transfer cylinder 8 that receives the sheet P is the gripper 16 that rotates to grip the sheet P, but the receiving portion may have a structure other than the gripper 16 that grips the sheet P.

In the above-described embodiments, CISs are used as position detectors to detect the position of the side end of a sheet. However, the position detector is not limited to a CIS and may be any detector such as multiple photosensors disposed along the width direction of the sheet as long as the detector detects the side edge of a sheet.

Further, in the above-described embodiments, both the angular displacement and the lateral displacement of a sheet are corrected. However, the sheet conveying device 7 according to this disclosure may be applied when correcting either one of the angular displacement and the lateral displacement of the sheet. Even in the configuration in which the lateral displacement alone is corrected, when the sheet has the angular displacement, the timing at which the leading end of the sheet reaches the downstream side leading end detection sensor varies by correcting the lateral displacement of the sheet. Therefore, the sheet conveyance timing of the sheet to the target position also varies.

Further, in the above-described embodiments, the sheet conveying device according to this disclosure is applied to an inkjet type image forming apparatus but is not limited to this configuration. For example, the sheet conveying device according to this disclosure may also be applicable to an electrophotographic image forming apparatus. Further, the conveying device this disclosure can be employed to not only a sheet conveying device that conveys a and a sheet such as an original document, but also a sheet conveying device that conveys a such as a printed circuit board.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a sensor configured to detect a position of a side end portion of a conveyance target medium;

rollers configured to move in at least one of a width direction of the conveyance target medium and a rotation direction of the conveyance target medium within a plane of sheet conveyance, while conveying the conveyance target medium, and to adjust a position of the conveyance target medium, according to the position of the side end portion of the conveyance target medium detected by the sensor;

a cylinder disposed downstream from the rollers in a sheet conveying direction and having a receiver mounted on the cylinder to receive the conveyance target medium; and circuitry configured to change a rotation speed of the cylinder according to the position of the conveyance target medium after adjusted by the rollers.

2. The sheet conveying device according to claim 1, further comprising:

a first rotary encoder configured to detect a drive position when the rollers move in the at least one of the width direction of the conveyance target medium and the rotation direction of the conveyance target medium within the plane of sheet conveyance, wherein the circuitry changes the rotation speed of the cylinder based on a detection result of the first rotary encoder.

3. The sheet conveying device according to claim 1, further comprising:

a second rotary encoder configured to detect the rotation speed of the cylinder, wherein the circuitry changes the rotation speed of the cylinder based on an amount of positional change of the conveyance target medium and a detection result of the second rotary encoder.

4. The sheet conveying device according to claim 1, further comprising:

a conveyance target medium speed detector configured to detect a conveying speed of the conveyance target medium, wherein the circuitry changes the rotation speed of the cylinder based on an amount of position change of the conveyance target medium and a detection result of the conveyance target medium speed detector.

5. The sheet conveying device according to claim 1, wherein the sensor detects the position of the side end portion of the conveyance target medium for multiple times, wherein the rollers adjusts the position of the conveyance target medium for multiple times according to the position of the side end portion of the conveyance target medium detected by the sensor, and wherein the circuitry changes the rotation speed of the cylinder for multiple times according to the position of the conveyance target medium after adjusted by the rollers.

6. The sheet conveying device according to claim 1, wherein each of a number of times to change the position of the conveyance target medium by the rollers and a number of times to change the rotation speed of the cylinder by the circuitry is smaller than a number of times to detect the position of the side end portion of the conveyance target medium by the sensor.

7. An image forming apparatus comprising the sheet conveying device according to claim 1.

8. A sheet conveying method comprising:

detecting a position of a side end portion of a conveyance target medium;

conveying the conveyance target medium according to the position of the side end portion of the conveyance target medium detected by the detecting;

moving rollers, during the conveying, in at least one of a width direction of the conveyance target medium and a rotation direction of the conveyance target medium within a plane of sheet conveyance;

adjusting a position of the conveyance target medium;

causing a cylinder to receive and convey the conveyance target medium; and changing a rotation speed of the cylinder according to the position of the conveyance target medium after adjusted by the adjusting.

9. The method according to claim 8, further comprising:

moving the conveyance target medium in the at least one of the width direction of the conveyance target medium and the rotation direction of the conveyance target medium within the plane of sheet conveyance of the conveyance target medium while conveying the conveyance target medium by the rollers;

changing the position of the conveyance target medium;

detecting a drive position of the rollers moved by the moving; and changing the rotation speed of the cylinder based on the drive position of the rollers detected by the detecting the drive position.

10. The method according to claim 8, further comprising:

changing the rotation speed of the cylinder based on an amount of change of the position of the conveyance target medium and the rotation speed of the cylinder.

11. The method according to claim 8, further comprising:

changing the rotation speed of the cylinder based on an amount of change of the position of the conveyance target medium and a conveying speed of the conveyance target medium directly detected.

12. The method according to claim 8, further comprising:

moving the conveyance target medium in the at least one of the width direction and the rotation direction within the plane of sheet conveyance for multiple times according to the position of the side end portion of the conveyance target medium detected;

adjusting the position of the conveyance target medium for multiple times; and changing the rotation speed of the cylinder for multiple times according to the position of the conveyance target medium after adjusted by the adjusting.

13. The method according to claim 8, wherein each of a number of times to change the position of the conveyance target medium and a number of times to change the rotation speed of the cylinder is smaller than a number of times to detect the position of the side end portion of the conveyance target medium.

14. An image forming method comprising:

conveying a conveyance target medium using the sheet conveying method according to claim 8, and forming an image on the conveyance target medium.

* * * * *